US011612866B2

(12) United States Patent
Danopoulos

(10) Patent No.: US 11,612,866 B2
(45) Date of Patent: Mar. 28, 2023

(54) ADAPTER AND ASSEMBLY FOR PHARMACEUTICAL COMPOUNDING

(71) Applicant: MEDISCA PHARMACEUTIQUE INC., St-Laurent (CA)

(72) Inventor: Panagiota Danopoulos, St-Laurent (CA)

(73) Assignee: MEDISCA PHARMACEUTIQUE INC., Quebec (CA)

( * ) Notice: Subject to any disclaimer, the term of this patent is extended or adjusted under 35 U.S.C. 154(b) by 90 days.

(21) Appl. No.: 16/835,538

(22) Filed: Mar. 31, 2020

(65) Prior Publication Data

US 2021/0299621 A1 Sep. 30, 2021

(51) Int. Cl.

| | |
|---|---|
| ***B01F 35/42*** | (2022.01) |
| ***B01F 27/232*** | (2022.01) |
| ***B01F 23/50*** | (2022.01) |
| ***B01F 29/00*** | (2022.01) |
| ***B01F 35/43*** | (2022.01) |
| *B01F 101/22* | (2022.01) |
| *B01F 101/00* | (2022.01) |

(52) U.S. Cl.

CPC ..... *B01F 27/2324* (2022.01); *B01F 23/59* (2022.01); *B01F 29/40* (2022.01); *B01F 35/421* (2022.01); *B01F 35/43* (2022.01); *B01F 2101/22* (2022.01); *B01F 2101/2204* (2022.01)

(58) Field of Classification Search

CPC ..... B01F 29/40; B01F 35/421
USPC ..... 285/420; 220/4.21, 4.24
See application file for complete search history.

(56) References Cited

U.S. PATENT DOCUMENTS

| | | | | | |
|---|---|---|---|---|---|
| 725,837 | A * | 4/1903 | Gmeiner | F16B 21/183 | 24/19 |
| 863,887 | A * | 8/1907 | Stuttle | F16L 21/06 | 285/373 |
| 964,739 | A * | 7/1910 | Balke | B65D 21/0234 | 220/4.24 |
| 1,243,748 | A * | 10/1917 | McMurtrie | H02G 3/0683 | 285/154.3 |
| 1,928,570 | A * | 9/1933 | Mustico | F16L 55/172 | 285/373 |
| 2,624,451 | A * | 1/1953 | Ewing | A47J 39/00 | 220/592.2 |
| 4,034,926 | A * | 7/1977 | Wegner | B65D 85/672 | 220/4.23 |

(Continued)

*Primary Examiner* — David L Sorkin
(74) *Attorney, Agent, or Firm* — Greenblum & Bernstein P.L.C.

(57) ABSTRACT

An assembly for insertion into a holder of a mixer, comprising: a dispenser having an exterior surface of which at least a band is symmetric about a longitudinal axis of the dispenser; and an adapter for surrounding at least the band of the exterior surface of the dispenser. The adapter comprises a closeable shell, the shell being configured to lock the dispenser in at least a region of the band so as to impede rotational slippage of the dispenser relative to the adapter about the longitudinal axis with the shell being closed. If the assembly is then locked to/engaged with the holder of a planetary mixer, this causes the assembly to undergo superimposed revolution and rotation movements in tandem with those of the holder, resulting in a desired level of mixing being imparted to the dispenser's contents, which may improve homogeneity and predictability of the mixing results.

9 Claims, 23 Drawing Sheets

(56) References Cited

U.S. PATENT DOCUMENTS

| | | | | |
|---|---|---|---|---|
| 4,497,581 | A * | 2/1985 | Miller | B01F 29/10 366/208 |
| 6,755,565 | B2 * | 6/2004 | Flackett | B01F 29/10 366/217 |
| 7,497,348 | B2 * | 3/2009 | Johnson | B01F 35/421 366/209 |
| 10,231,903 | B2 | 3/2019 | Danopoulos et al. | |
| 2006/0109739 | A1 * | 5/2006 | Huckby | B01F 35/425 366/208 |
| 2020/0054522 | A1 | 2/2020 | Danopoulos et al. | |

* cited by examiner

ADAPTER AND ASSEMBLY FOR PHARMACEUTICAL COMPOUNDING

FIELD

This disclosure relates generally to the field of pharmaceutical compounding and, more particularly, to adapters and assemblies designed to be compatible with mixers in a pharmacy setting.

BACKGROUND

Compounding pharmacists are increasingly finding it useful to employ a planetary mixer for mixing compounds directly in the dispenser used to dispense the product. The reasons for this are many, including better mixing performance compared to an electronic mortar and pestle (EMP), better hygiene, less cross-contamination and compliance with materials handling requirements. Also, there are good economic reasons, including less waste of the compounded product and eliminating the time spent on transfer.

Many adapter solutions have heretofore been built to fit the plastic containers supplied by manufacturers of planetary mixers. Such containers are fitted with a dispenser via an in-container adapter and then engaged into a holder of the planetary mixer. However, the plastic containers supplied by manufacturers of planetary mixers tend to have a smooth inner surface which makes it difficult to fix the position of the dispenser and adapter within the container.

As such, the industry would welcome solutions that bypass the plastic container typically supplied with a planetary mixer and that instead engage directly with the holder of the planetary mixer.

SUMMARY

In accordance with various aspects, the present disclosure relates to an assembly comprising an adapter and a dispenser, in which the adapter is designed to surround the dispenser in a secure grip, and compatible to be inserted onto a holder of a planetary mixer.

According to a first broad aspect, there is provided an assembly for insertion into a holder of a mixer, comprising: a dispenser having an exterior surface of which at least a band is symmetric about a longitudinal axis of the dispenser; and an adapter for surrounding at least the band of the exterior surface of the dispenser, the adapter comprising a closeable shell, the shell being configured to lock the dispenser in at least a region of the band so as to impede rotational slippage of the dispenser relative to the adapter about the longitudinal axis with the shell being closed.

According to another broad aspect, there is provided an adapter for receiving a dispenser with a longitudinal axis, comprising: at least two mating shell components wherein, when the shell components are in a mating relationship, the shell components define an inner region that is configured to compress at least part of an outer surface of the dispenser to impede rotational motion of the dispenser about the longitudinal axis relative to the adapter.

According to another broad aspect, there is provided an adapter for receiving a dispenser with a longitudinal axis, comprising: at least two mating shell components defining an inner region that is configured to contact at least part of an outer surface of the dispenser, the shell components having a set of teeth and grooves in an area of the inner region, the set of teeth and grooves for engaging a set of teeth and grooves along the part of the outer surface of the dispenser when the shell components are in a mating relationship so as to lock the dispenser against rotational motion about the longitudinal axis relative to the adapter.

BRIEF DESCRIPTION OF DRAWINGS

A detailed description of embodiments is provided below, by way of example only, with reference to drawings accompanying this description, in which.

It is to be expressly understood that the description and drawings are only for purposes of illustrating certain embodiments and are an aid for understanding. They are not intended to be and should not be limiting.

DETAILED DESCRIPTION OF EMBODIMENTS

The mixing process in pharmaceutical compounding is vital to the effective dispersion of a composition. Mixing devices such as planetary mixers are widely used in the industry in order to provide superior homogeneity while avoiding the introduction of air during mixing.

Figure 19:
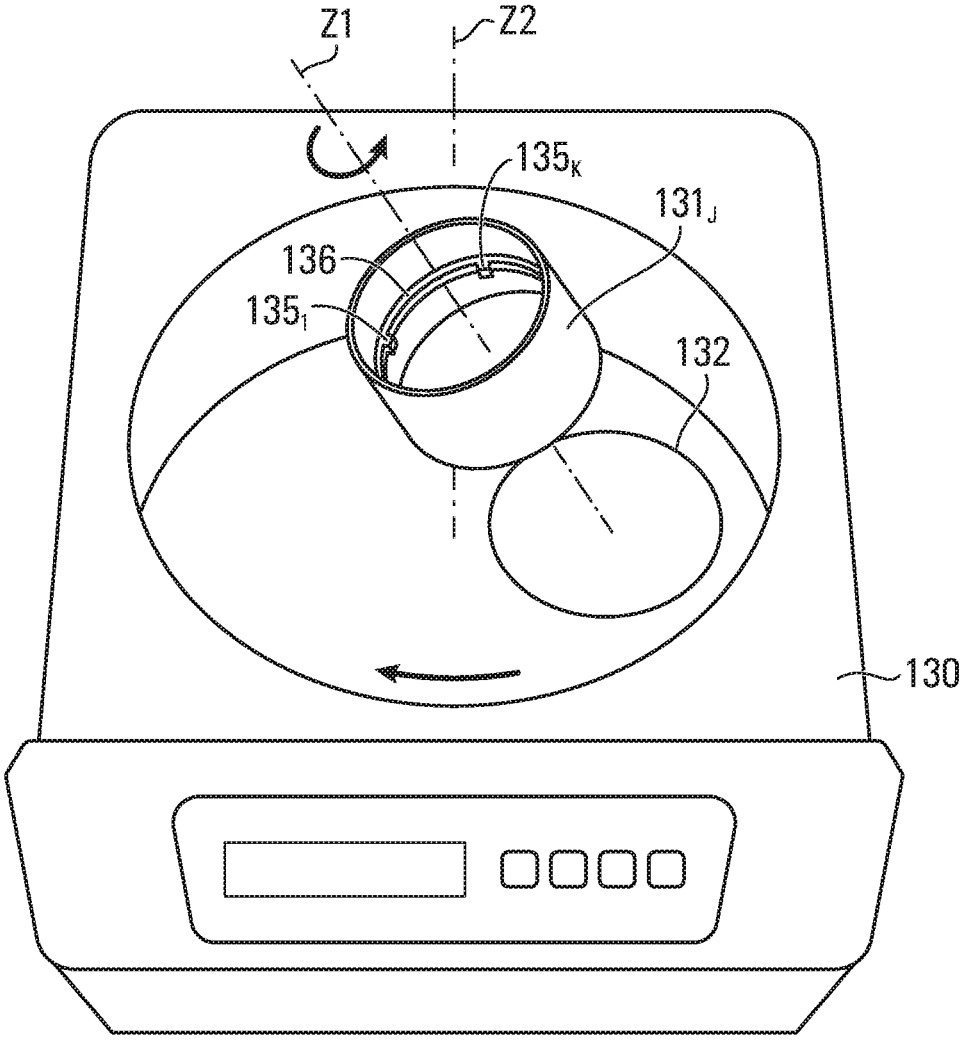
FIG. 19 is a perspective view of a mixing device with a holder.

As best shown in FIG. 19, a mixing device 130 includes a motor 132 connected to one or several holders $\mathbf{131}_J$. In some embodiments, the mixing device 130 is a planetary mixer whereby the motor 132 subjects the holder $\mathbf{131}_J$ or holders to superimposed revolution and rotation movements. Rotation movement is about a longitudinal axis Z1 of the holder $\mathbf{131}_J$, whereas revolution movement is about an axis Z2 of the mixing device 130. A non-limiting example of a suitable mixing device 130 is the Maz Mixer line sold by Medisca Pharmaceutique Inc., St-Laurent, Canada, which includes the Mazerustar KK-300SS and KK-400W, for instance.

In accordance with embodiments of this disclosure, an assembly is provided, which comprises a dispenser having an exterior surface of which at least a band is symmetric about a longitudinal axis of the dispenser; and an adapter for surrounding at least the band of the exterior surface of the dispenser. The adapter comprises a closeable shell, the shell being configured to lock the dispenser in at least a region of the band so as to impede rotational slippage of the dispenser relative to the adapter about the longitudinal axis with the shell being closed. If the assembly is then locked to/engaged with the holder $\mathbf{131}_J$, this causes the assembly to undergo superimposed revolution and rotation movements in tandem with those of the holder $\mathbf{131}_J$, resulting in a desired level of mixing being imparted to the dispenser's contents which, in turn, may improve homogeneity and predictability of the mixing results.

Figure 19A:
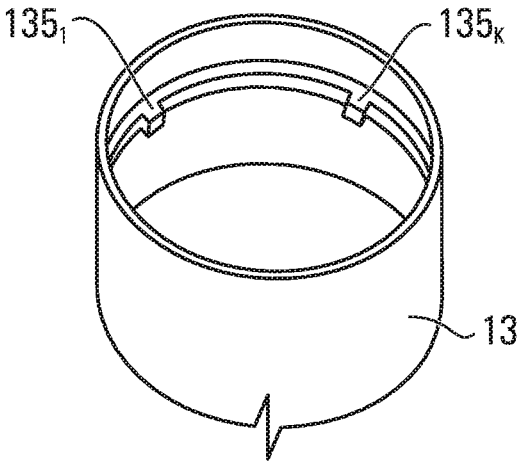
FIG. 19A shows a zoomed-in view of the holder of the mixing device of FIG. 19.
Figure 20:
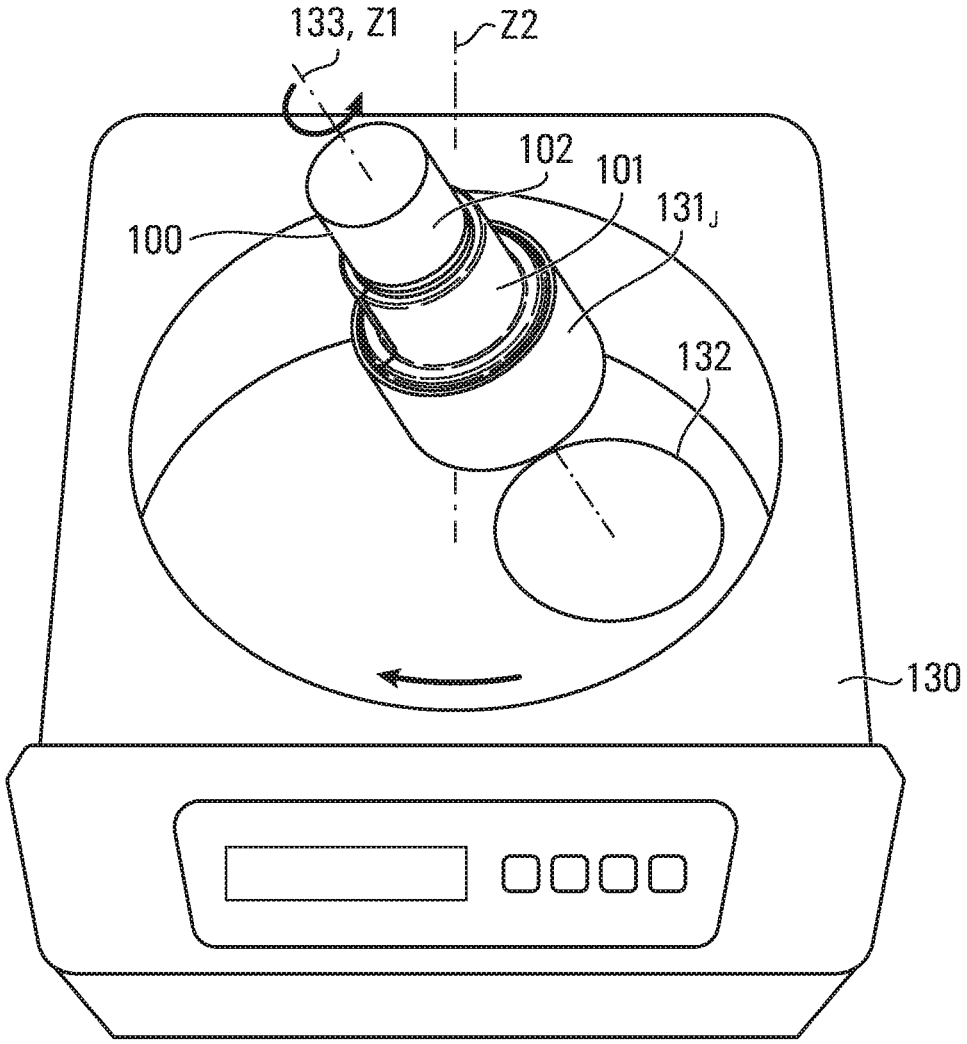
FIG. 20 is an isometric view of the mixing device of FIG. 19 with an assembly positioned in the holder.
Figure 21:
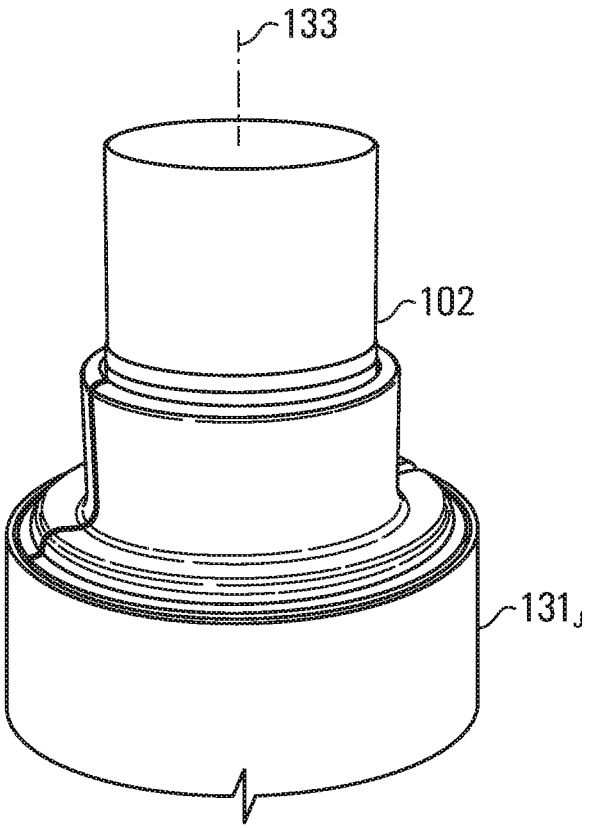
FIG. 21 is a zoomed-in view of the first embodiment of the assembly positioned in the holder.
Figure 22:
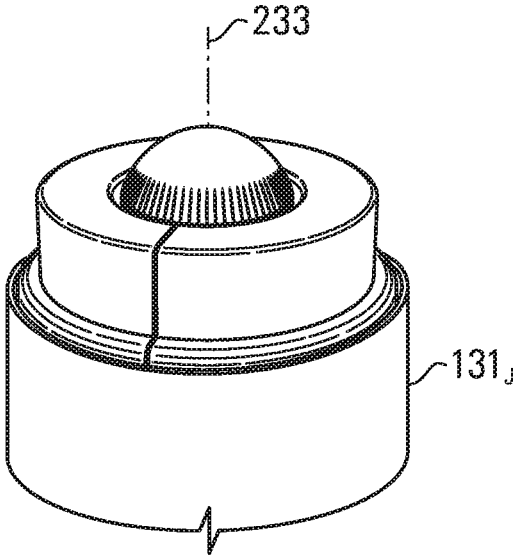
FIG. 22 is a zoomed-in view of the second embodiment of the assembly positioned in the holder.

In some embodiments, the adapter x01 (in the following, x=1, 2 and/or 25, as appropriate) has an outer surface x04 comprising at least one securing element $\mathbf{x05}_1$, $\mathbf{x05}_2$, $\mathbf{x05}_A$, each of which is configured to mate with a corresponding one of at least one securing element $\mathbf{135}_1$, $\mathbf{135}_K$ of the holder $\mathbf{131}_J$ so as to rotationally lock the adapter x01 relative to the holder $\mathbf{131}_J$. In other words, there is a securing relationship between corresponding ones of the securing elements which ensures that the adapter x01 is subjected to the same rotation and revolution motion as the holder $\mathbf{131}_J$. FIG. 19A is a zoomed-in illustration of the empty holder $\mathbf{131}_J$ showing an example of arrangement of two securing elements $\mathbf{135}_1$, $\mathbf{135}_K$.

In the illustrated embodiments, each of the at least one securing element $\mathbf{x05}_1$, $\mathbf{x05}_2$; $\mathbf{x05}_A$ is embodied as a notch on the outer surface x04 of the adapter x01, and each of the at least one securing element $\mathbf{135}_1$, $\mathbf{135}_K$ is embodied as a projection on an inner surface of the holder $\mathbf{131}_J$. Each of the at least one securing element $\mathbf{x05}_1$, $\mathbf{x05}_2$, $\mathbf{x05}_A$ is compatible to engage with a corresponding one of the at least one securing element $\mathbf{135}_1$, $\mathbf{135}_K$. This arrangement ensures a more effective rotational locking of the adapter x01 to the holder $\mathbf{131}_J$ during operation of the mixing device 130.

It should be apparent to those ordinarily skilled in the art that other arrangements of the securing elements are possible. Another example of such arrangement could be to have the securing elements on the outer surface x04 of the adapter x01 implemented as notches which are compatible to engage with corresponding projections on the inner surface of the holder $\mathbf{131}_J$. Still other arrangements are possible.

Multi-Component Shell Embodiments

In accordance with various non-limiting embodiments, there is provided an assembly x00 comprising an adapter x01 and a dispenser x02. The dispenser x02 generally has an elongated dimension along a longitudinal axis x33, such that when the dispenser x02 is placed inside the adapter x01 to form the assembly x00, the dispenser x02 and the adapter x01 share the same longitudinal axis x33.

The adapter x01 comprises a closeable shell which, in various non-limiting embodiments, may include a plurality of mating shell components. In the illustrated examples, the adapter x01 comprises two mating shell components $\mathbf{x25}_1$, $\mathbf{x25}_H$, but in other examples, the adapter x01 may comprise more than two mating shell components.

In this embodiment, the shell components $\mathbf{x25}_1$, $\mathbf{x25}_H$ of the adapter x01 are in a mating relationship when held together and prevented from separating as a result of being placed in and encapsulated by the holder $\mathbf{131}_J$. This means that, if placed outside the holder $\mathbf{131}_J$, the two shell components $\mathbf{x25}_1$, $\mathbf{x25}_H$ are free to at least partly disengage from the mating relationship in response to a separating force, e.g., a force applied radially outwards from the longitudinal axis x33.

In some embodiments, the mating relationship of the two shell components $\mathbf{x25}_1$, $\mathbf{x25}_H$ of the adapter 101 may be achieved through a mating mechanism that involves cooperating grooves $\mathbf{x08}_D$, $\mathbf{x08}_3$, $\mathbf{x08}_2$, $\mathbf{x08}_1$ and, respectively, projections $\mathbf{x09}_1$, $\mathbf{x09}_2$, $\mathbf{x09}_3$, $\mathbf{x09}_E$. It should be noted that the mating mechanism is designed in accordance with the geometry of the adapter x01 and in this case the cooperating components of the mating mechanism are located on a surface created by an imaginary cutting plane x45 (hereinafter "section surface").

For example, the mating mechanisms may comprise grooves $\mathbf{x08}_1$, $\mathbf{x08}_2$, $\mathbf{x08}_3$, $\mathbf{108}_D$ and projections $\mathbf{x09}_1$, $\mathbf{x09}_2$, $\mathbf{x09}_3$, $\mathbf{x09}_E$, along the section surface and starting from a location adjacent to a flange $\mathbf{x20}_1$, $\mathbf{x20}_F$. Additionally, each of the shell components $\mathbf{x25}_1$, $\mathbf{x25}_H$ of the adapter x01 may comprise a flange $\mathbf{x20}_1$, $\mathbf{x20}_F$ for supporting a bottom x46 of the dispenser x02 within the adapter x01 when the shell components $\mathbf{x25}_1$, $\mathbf{x25}_H$ are in a mating relationship. The flange $\mathbf{x20}_1$, $\mathbf{x20}_F$ may serve the function of a stopper to prevent the dispenser x02 from being pushed into the empty cavity of the holder $\mathbf{131}_J$, for example when removing the assembly x00 from the holder $\mathbf{131}_J$ after operation of the mixing device 130.

Also, a lip may cover at least part of a top of the dispenser (e.g., dispenser 2502), or part of a top of a lid of the dispenser (e.g., dispenser 202).

The shell components $\mathbf{x25}_1$, $\mathbf{x25}_H$ of the adapter x01 may be made using additive manufacturing techniques such as 3D printing or rapid prototyping, among others. In another example, the shell components $\mathbf{x25}_1$, $\mathbf{x25}_H$ of the adapter x01 are molded. There are various types of molding techniques which could be applicable to the present invention. For instance, injection molding or blow molding may be employed to produce the shell components in a variety of materials, including, plastic or polymer, to name a few non-limiting possibilities. Those ordinarily skilled in the art will appreciate that the combination of specific material and manufacturing technique may be chosen depending on operational requirements and available equipment.

Adapter/Dispenser Assembly for Dispenser Type #1

Figure 1:
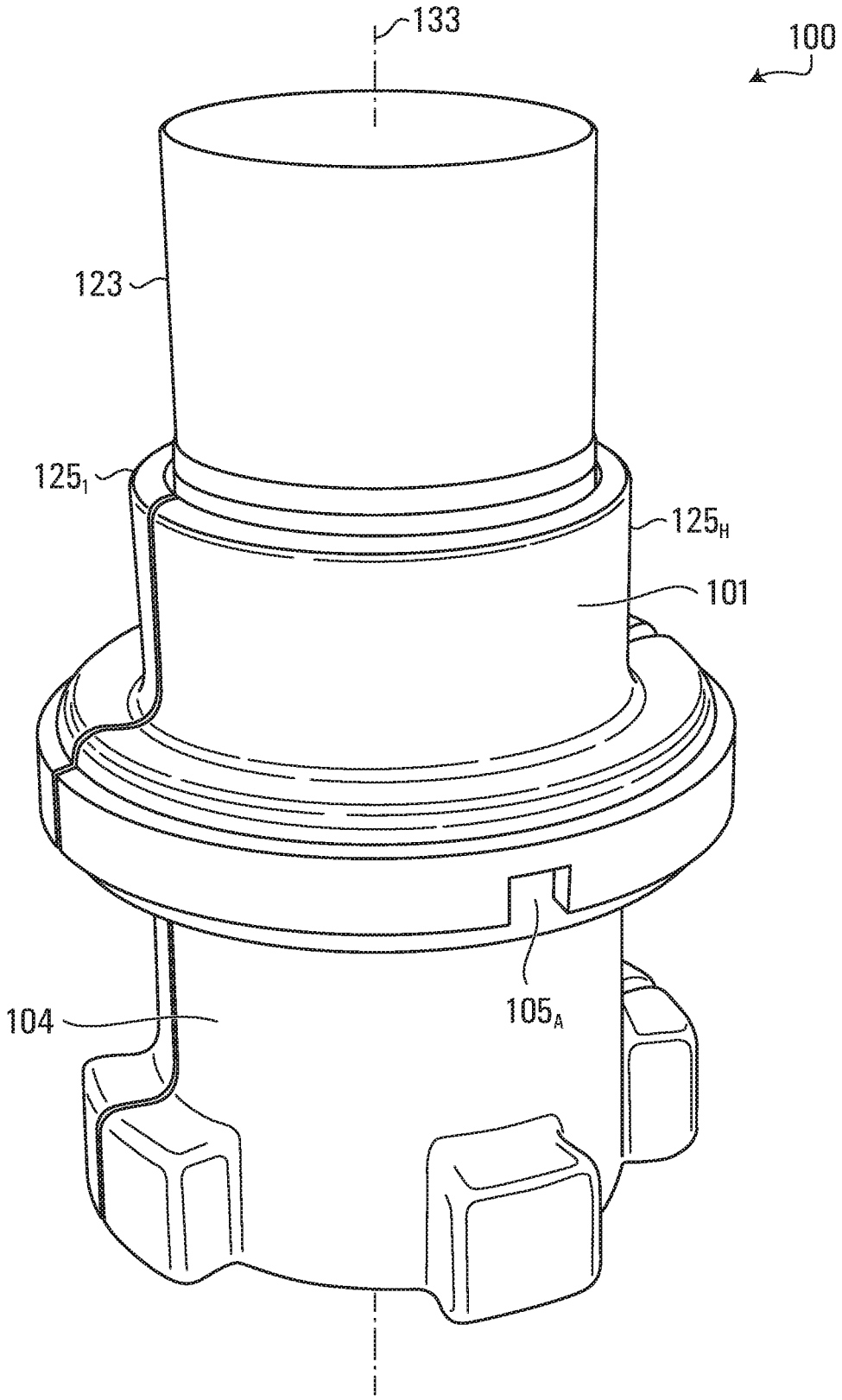
FIG. 1 is a perspective view of an assembly comprising a first embodiment of an adapter and a dispenser held by the adapter, the adapter being in a closed position.

FIG. 1 depicts the shell components $\mathbf{125}_1$, $\mathbf{125}_H$ in a mating relationship configured to have an inner region $\mathbf{121}_1$, $\mathbf{121}_2$, $\mathbf{121}_3$, $\mathbf{121}_G$ opposite an outer band 103 of the dispenser 102. One function of the adapter 101 may be to maintain the dispenser 102 at the same rotation and revolution speed as the holder $\mathbf{131}_J$ during the operation of the mixer 130. The structure of this embodiment of the dispenser 102 is now explained in further detail.

Figure 2:
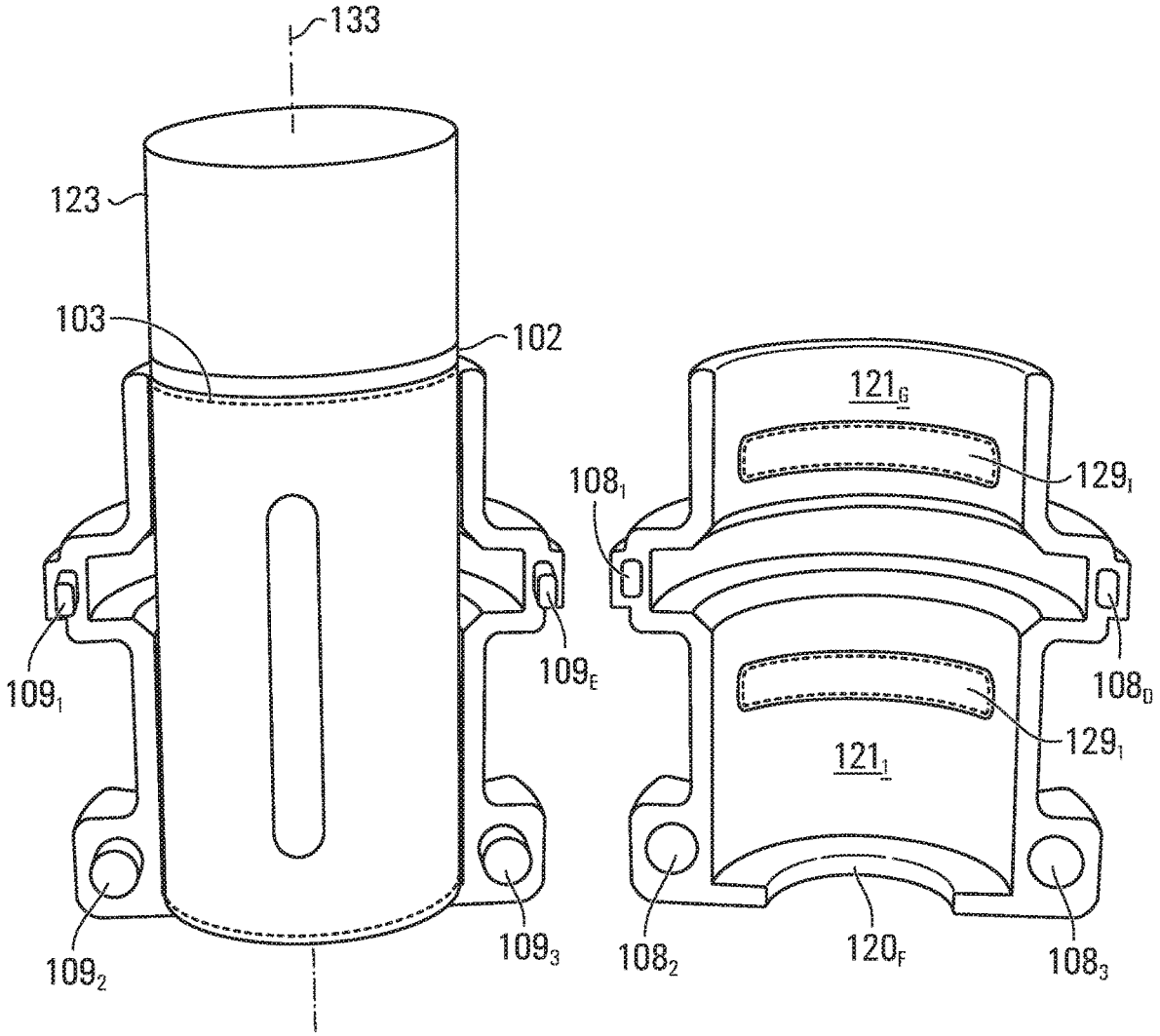
FIG. 2 is an interior perspective view of the assembly of FIG. 1, with shell components of the adapter being detached from one another.
Figure 3:
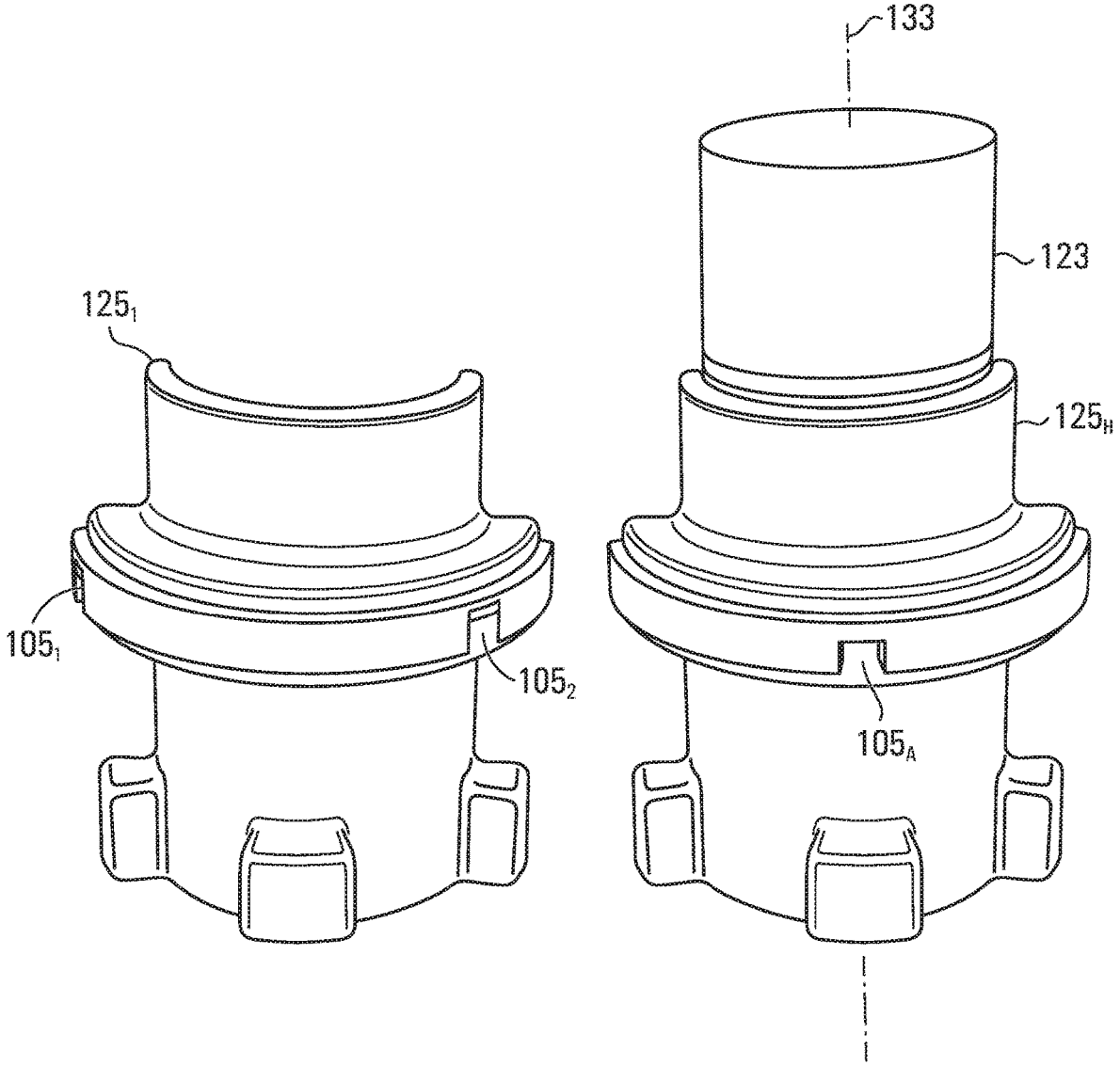
FIG. 3 is an exterior perspective view of the assembly of FIG. 1, with shell components of the adapter being detached from one another.
Figure 4:
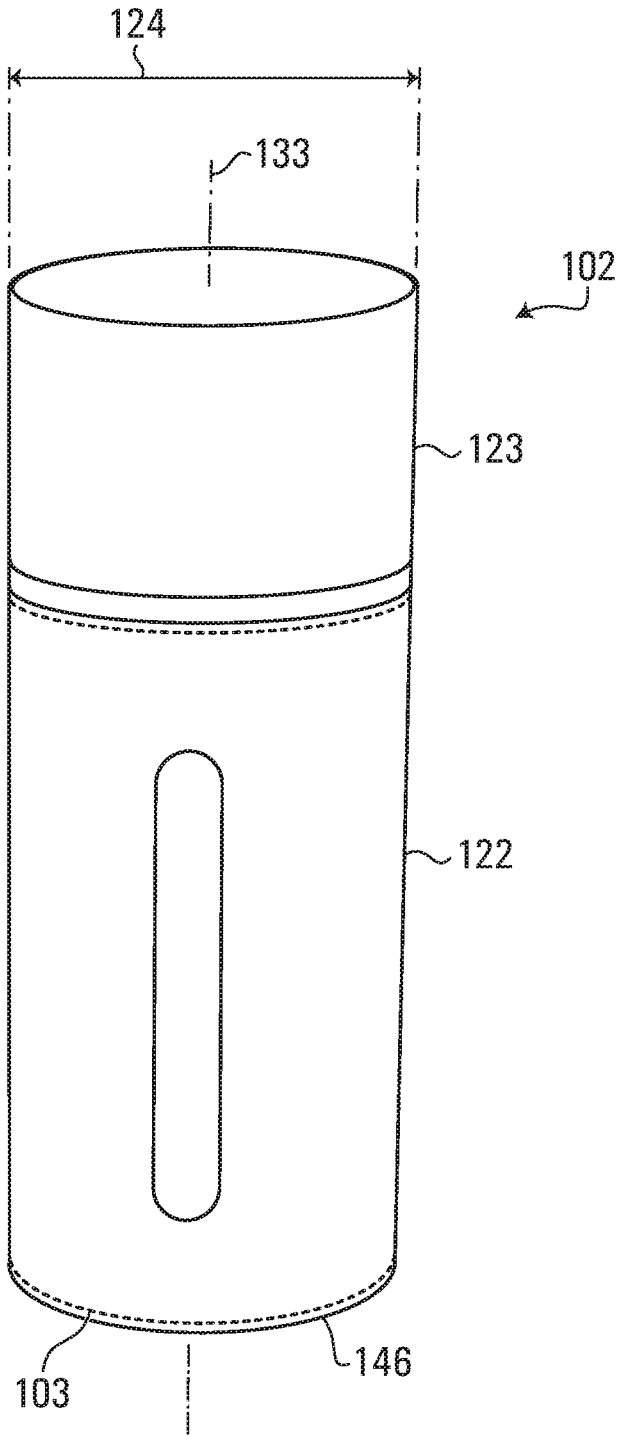
FIG. 4 is a perspective view of a type of dispenser suitable for use with the first embodiment of the adapter.
Figure 5:
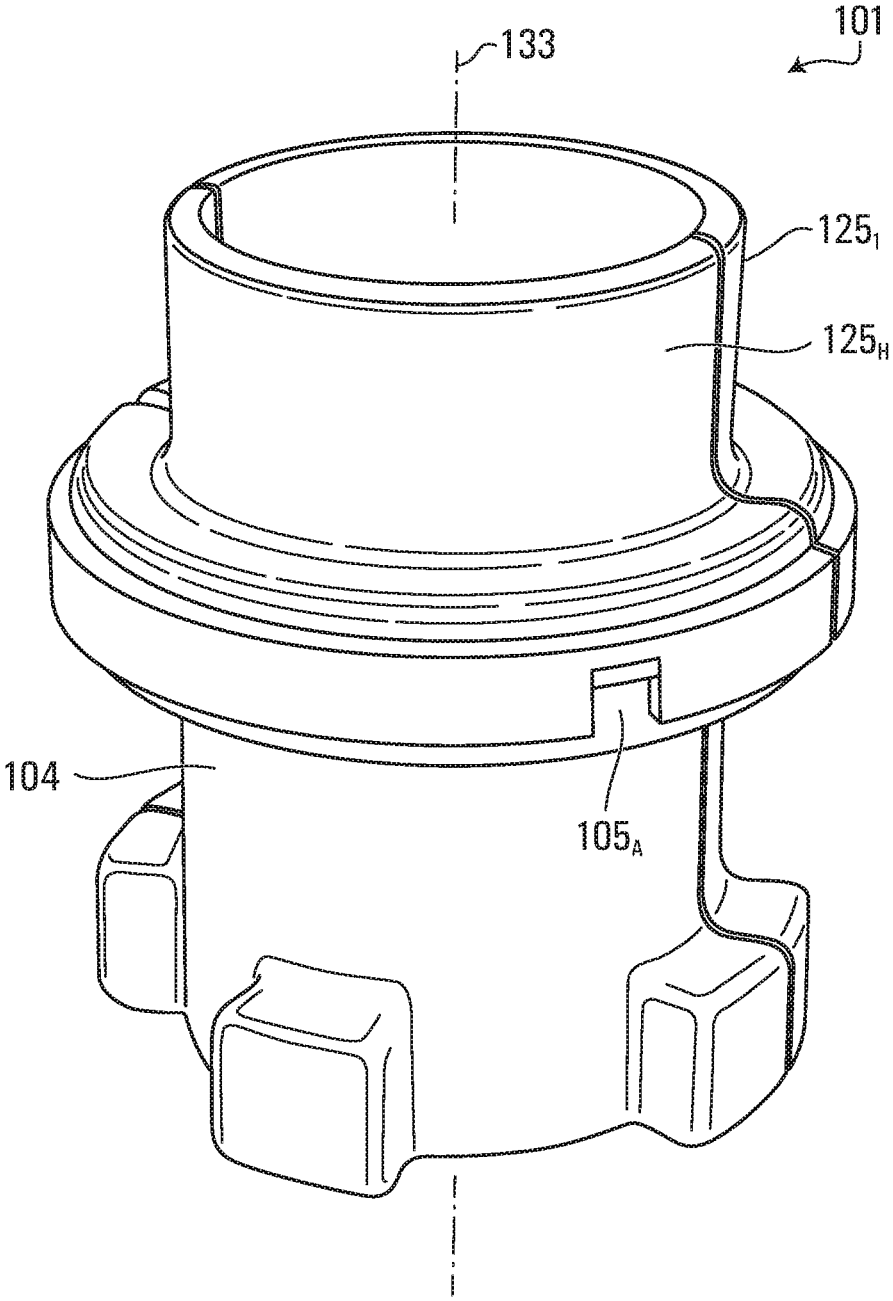
FIG. 5 is a perspective view of the first embodiment of the adapter in a closed position in the absence of a dispenser.

In a non-limiting example of implementation and with further reference to FIG. 2, the dispenser 102 has a generally symmetric profile/form factor about the longitudinal axis 133. More specifically, and with reference to FIG. 4, the dispenser 102 comprises a body 122 and a cap 123 and has the outer band 103 surrounding the longitudinal axis 133 that defines a minimum first diameter 124 of an imaginary cylinder into which the outer band 103 may fit. In this embodiment, the outer band 103 is characterized as having a smooth surface, without apparent irregularities. In this case, and with further reference to FIG. 4, the dispenser 102 is substantially cylindrical in profile and the cap 123 has substantially the same diameter as the body 122; as such, the cap 123 is an extension of the cylindrical outer shape of the body 122. One specific example of the dispenser 102 is the MD line of pump dispensers sold by Medisca Pharmaceutique Inc., St-Laurent, Canada, with example volumes of 30 mL, 50 mL, 80 mL and 100 mL. This example presents a cylindrical body and a uniform outer surface in the area of the outer band 103.

Figure 23:
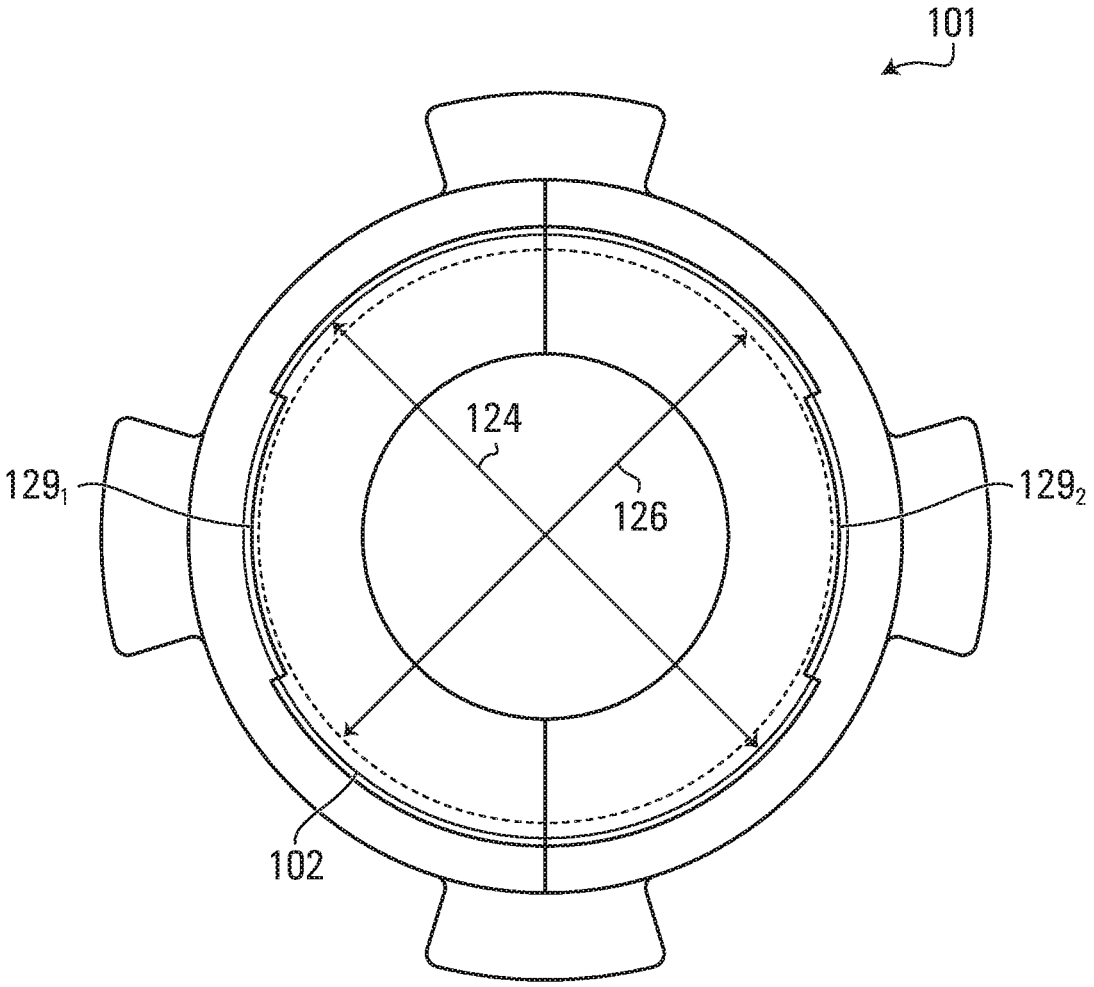
FIG. 23 is cross-sectional view along the line 147 in FIG. 6.

As previously mentioned, the adapter 101 surrounds at least the outer band 103 of the dispenser 102. In particular, the adapter 101 is configured to have an inner region $\mathbf{121}_1$, $\mathbf{121}_2$, $\mathbf{121}_3$, $\mathbf{121}_G$ opposite the outer band 103 of the dispenser 102 when the shell components $\mathbf{125}_1$, $\mathbf{125}_H$ are in a mating relationship. These inner regions $\mathbf{121}_1$, $\mathbf{121}_2$, $\mathbf{121}_3$, $\mathbf{121}_G$ defines a maximum second diameter 126 of an imaginary cylinder that may fit within the inner region $\mathbf{121}_1$, $\mathbf{121}_2$, $\mathbf{121}_3$, $\mathbf{121}_G$ of the adapter 101 when the shell components are in a mating relationship. FIG. 23 depicts a cross-section (along the line 147 in FIG. 6) of the adapter 101 wherein the second diameter 126 is slightly less than the first diameter 124 (e.g., by a difference of less than 5 mm and in some cases by a difference of less than 1 mm and in other cases by a difference of between 1 mm and 5 mm and in other cases by a difference of between 100 microns and 5 mm). The inner region $\mathbf{121}_1$, $\mathbf{121}_2$, $\mathbf{121}_3$, $\mathbf{121}_G$ of the adapter 101 and the outer band 103 of the dispenser 102 are configured to cooperate to and provide an anti-slippage feature, whereby rotational motion of the dispenser 102 about the longitudinal axis 133 is impeded when the shell components $\mathbf{125}_1$, $\mathbf{125}_H$ are in a mating relationship. This will now be described in greater detail.

In the illustrated embodiment, the adapter 101 is designed to comprise at least one projection $\mathbf{129}_1$, $\mathbf{129}_2$, $\mathbf{129}_3$, $\mathbf{129}_I$ projecting from the inner region $\mathbf{121}_1$, $\mathbf{121}_2$, $\mathbf{121}_3$, $\mathbf{121}_G$ opposite the outer band 103. In the illustrated embodiment, the projections $\mathbf{129}_1$, $\mathbf{129}_2$, $\mathbf{129}_3$, $\mathbf{129}_I$, by virtue of projecting in a radial direction, define the second diameter 126. Since the second diameter 126 is less than the first diameter 124, pressure is applied so as to slightly deform the outer band 103 when the shell components $\mathbf{125}_1$, $\mathbf{125}_H$ are in a mating relationship and fully encapsulated within the holder $\mathbf{131}_J$. As a result, slippage of the adapter 101 about the longitudinal axes Z1, 133 is impeded. Indeed, the outer band 103 experiences a temporary change in the shape of the body 122 (i.e., deformation) caused by the application of pressure when the assembly 100, consisting of the dispenser 102 and the adapter 101, is placed into the holder $\mathbf{131}_J$. This configuration provides an effective grasp of the dispenser 102 during operation of the mixing device 130. The material of the body 122 is sufficiently elastic so that the applied stress is within the elastic limits of the material and the body 122 returns to its original shape upon removal from the adapter 101.

It should be noted that the number of projections $\mathbf{129}_1$, $\mathbf{129}_2$, $\mathbf{129}_3$, $\mathbf{129}_I$ may differ based on specific operational requirements. In some cases, there are two oppositely aligned projections $\mathbf{129}_1$, $\mathbf{129}_2$, $\mathbf{129}_3$, $\mathbf{129}_I$, whereas in other embodiments there may be a greater number of projections, or there may be a single one. In still other embodiments, the inner region $\mathbf{121}_1$, $\mathbf{121}_2$, $\mathbf{121}_3$, $\mathbf{121}_G$ itself defines the second diameter 126 (when the adapter is in a closed, operating position, i.e., when its closeable shell is closed) and there are no projections to project from the surface of the inner region $\mathbf{121}_1$, $\mathbf{121}_2$, $\mathbf{121}_3$, $\mathbf{121}_G$. As such, pressure comes from the inner region $\mathbf{121}_1$, $\mathbf{121}_2$, $\mathbf{121}_3$, $\mathbf{121}_G$ as a whole.

As mentioned in more general terms earlier, the projections $\mathbf{129}_1$, $\mathbf{129}_2$, $\mathbf{129}_3$, $\mathbf{129}_I$ on the inner region of the adapter 101 may be located on each shell component $\mathbf{125}_1$, $\mathbf{125}_H$ so that inward radial pressure towards the longitudinal axis 133 is applied more evenly on the outer band 103 of the body 122. Additionally, in some embodiments, there may be a plurality of projections $\mathbf{129}_1$, $\mathbf{129}_2$, $\mathbf{129}_3$, $\mathbf{129}_I$ distributed axially (i.e., along the longitudinal axis 133) so as to compress the dispenser 102 at multiple places along the longitudinal axis 133. In such embodiments, the application of pressure is configured to slightly deform the outer band 103, in at least two positions along the longitudinal axis 133 when the closeable shell is closed and the shell components $\mathbf{125}_1$, $\mathbf{125}_H$ are in a mating relationship. Again, the outer band 103 experiences a temporary change in the shape of the body 122, this time caused by the application of pressure in at least two positions along the longitudinal axis 133 when the assembly 100, consisting of the dispenser 102 and the adapter 101, is placed onto the holder $\mathbf{131}_J$. This may further impede slippage of the adapter 101 about the longitudinal axis 133. In some embodiments, the axially distributed projections $\mathbf{129}_1$, $\mathbf{129}_2$, $\mathbf{129}_3$, $\mathbf{129}_I$ are implemented in pairs so as to impede slippage of the adapter 101 about the longitudinal axis through the application of pressure so as to slightly deform the outer band 103 from opposite radial directions when the shell components $\mathbf{125}_1$, $\mathbf{125}_H$ are in a mating relationship. For illustration purposes, FIG. 6 present two pairs of projections $\mathbf{129}_1$, $\mathbf{129}_2$, $\mathbf{129}_3$, $\mathbf{129}_I$ axially spaced along the inner region $\mathbf{121}_1$, $\mathbf{121}_2$, $\mathbf{121}_3$, $\mathbf{121}_G$ of the shell components $\mathbf{125}_1$, $\mathbf{125}_H$.

Figure 6:
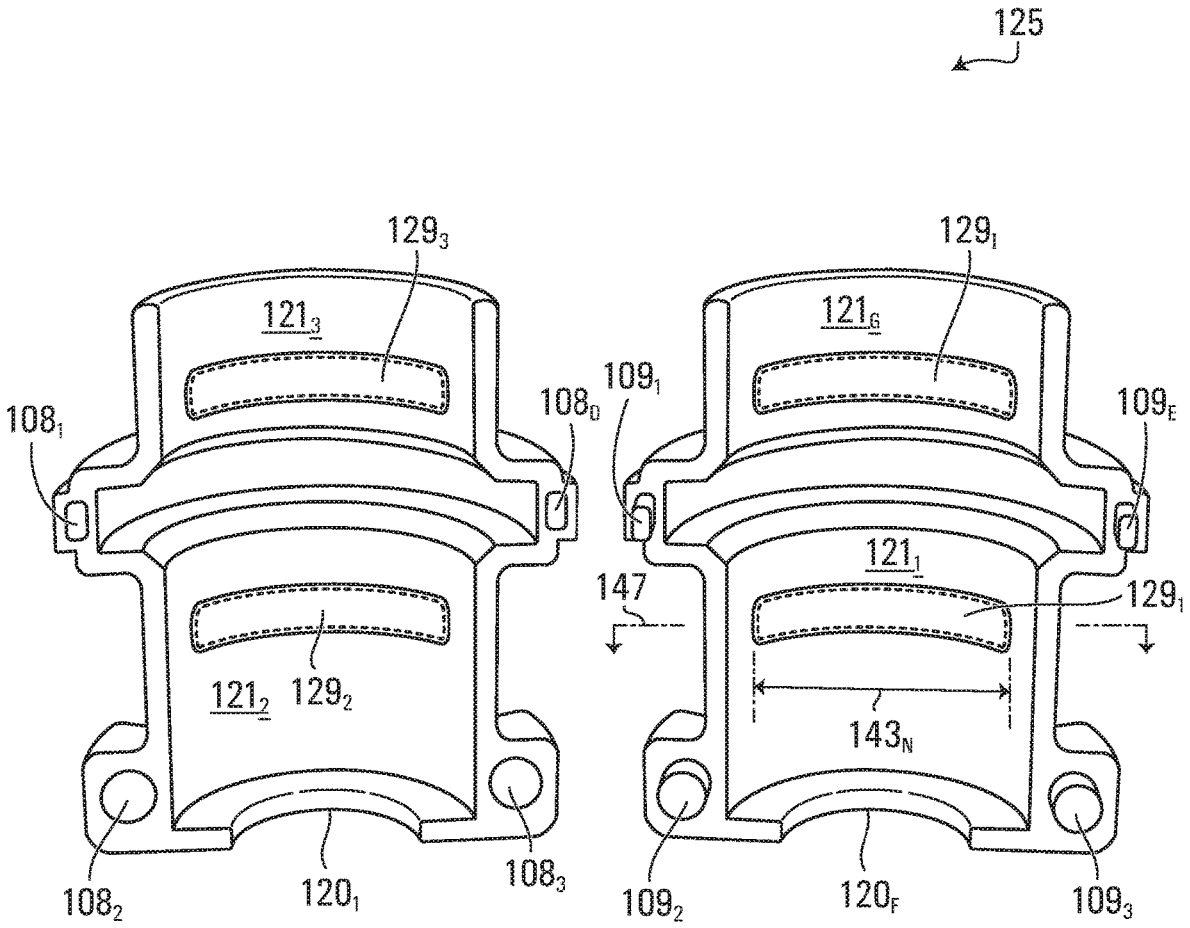
FIG. 6 shows an interior perspective view of the first embodiment of the adapter, with shell components of the adapter detached from one another and in the absence of a dispenser.
Figure 7:
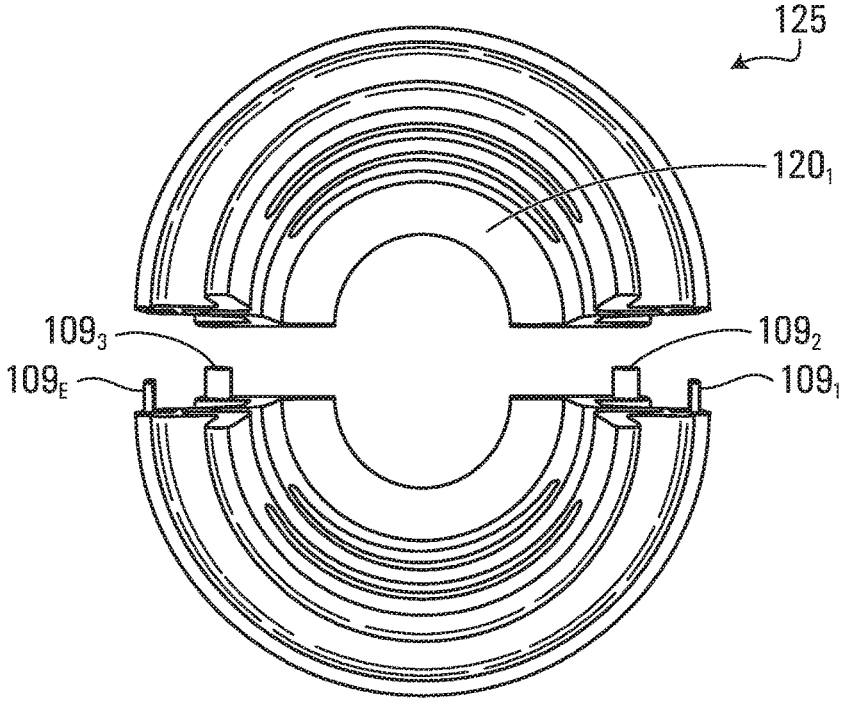
FIG. 7 is a top view of the first embodiment of the adapter, with shell components detached from one another.
Figure 8:
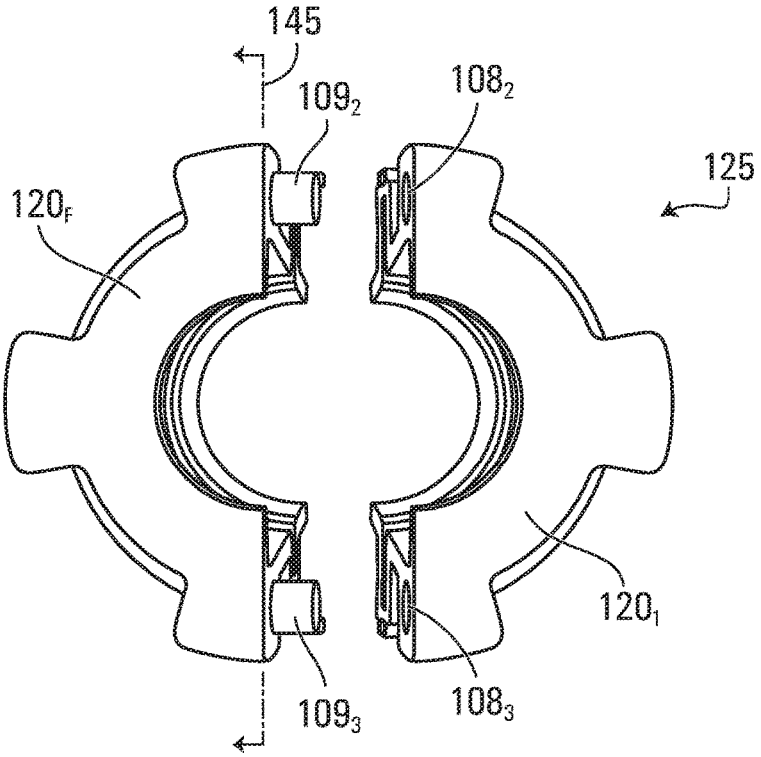
FIG. 8 is a bottom view of the first embodiment of the adapter, with shell components detached from one another.

With further reference to FIG. 6, each of the projections $\mathbf{129}_1$, $\mathbf{129}_2$, $\mathbf{129}_3$, $\mathbf{129}_I$ occupies an arc length $\mathbf{143}_N$, which may be at least 90 degrees. However, it should be appreciated that there is no particular limit on the arc length $\mathbf{143}_N$ covered by each projection $\mathbf{129}_1$, $\mathbf{129}_2$, $\mathbf{129}_3$, $\mathbf{129}_I$ or the overall cumulative arc length covered by multiple ones of the projections $\mathbf{129}_1$, $\mathbf{129}_2$, $\mathbf{129}_3$, $\mathbf{129}_I$. The arc length $\mathbf{143}_N$ may be designed so as to meet operational requirements. As a result, each arc length $\mathbf{143}_N$, or the cumulative arc, length may amount to 45 degrees, 90 degrees, or any other value, depending on operational considerations.

Adapter/Dispenser Assembly for Dispenser Type #2

Figure 14:
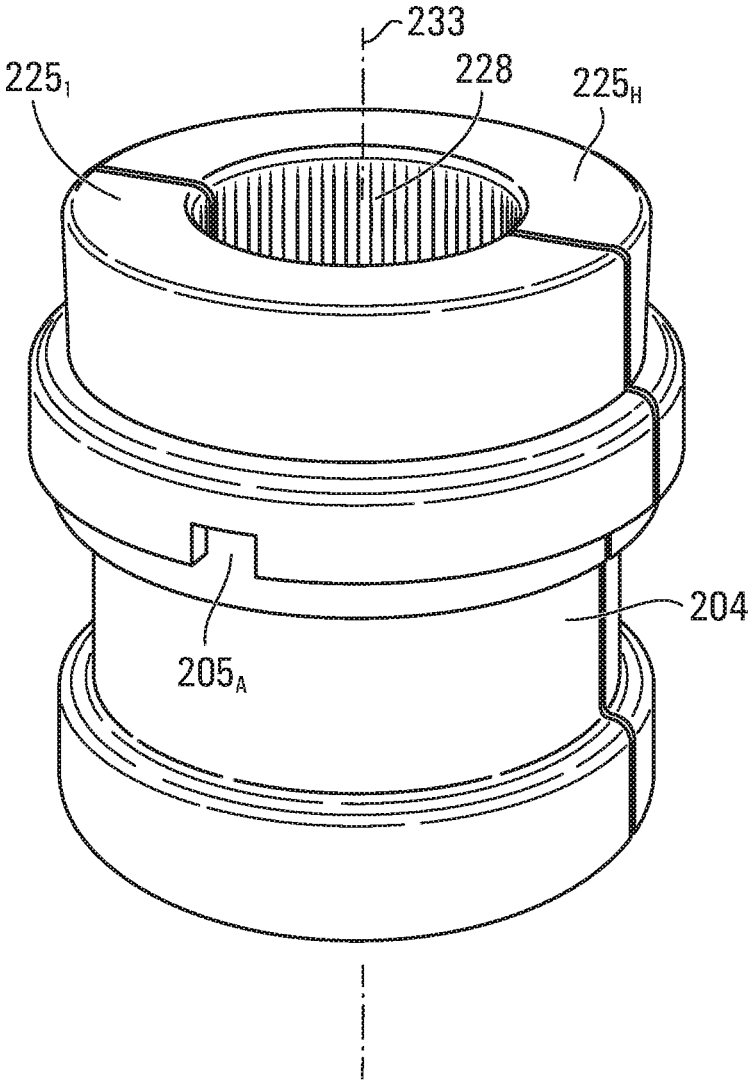
FIG. 14 is a perspective view of the second embodiment of the adapter in a closed position in the absence of a dispenser.

In accordance with a second embodiment, and with reference to FIGS. 9 to 18, there is provided a dispenser 202 (analogous to the dispenser 102) and a corresponding adapter 201 (analogous to the adapter 101). The adapter 201 is designed to be inserted into the aforementioned holder $\mathbf{131}_J$ of the aforementioned mixing device 130. Moreover, when the dispenser 202 is placed inside the adapter 201 to form an assembly 200, the dispenser 202 and the adapter 201 share a same longitudinal axis. As depicted in FIG. 14, the adapter 201 has an outer surface 204 comprising at least one securing element $\mathbf{205}_1$, $\mathbf{205}_A$ that is configured to mate with a corresponding one of the at least one securing element $\mathbf{135}_1$, $\mathbf{135}_K$ on the holder $\mathbf{131}_J$ to rotationally lock the adapter 201 relative to the holder $\mathbf{131}_J$. In other words, the securing elements $\mathbf{205}_1$, $\mathbf{205}_A$, $\mathbf{135}_1$, $\mathbf{135}_K$ are in a mating relationship to ensure that the adapter 201 is subjected to the same rotation and revolution motion as the holder $\mathbf{131}_J$. Each of the at least one securing element $\mathbf{205}_1$, $\mathbf{205}_A$ may be embodied as a notch and, as previously described, each of the at least one securing element $\mathbf{135}_1$, $\mathbf{135}_K$ may be embodied as a projection. Moreover, each of the at least one securing element $\mathbf{205}_1$, $\mathbf{205}_A$ on the outer surface 204 of the adapter 201 is compatible to engage with a corresponding one of the at least one securing element $\mathbf{135}_1$, $\mathbf{135}_K$ on the inner surface of the holder $\mathbf{131}_J$.

Figure 9:
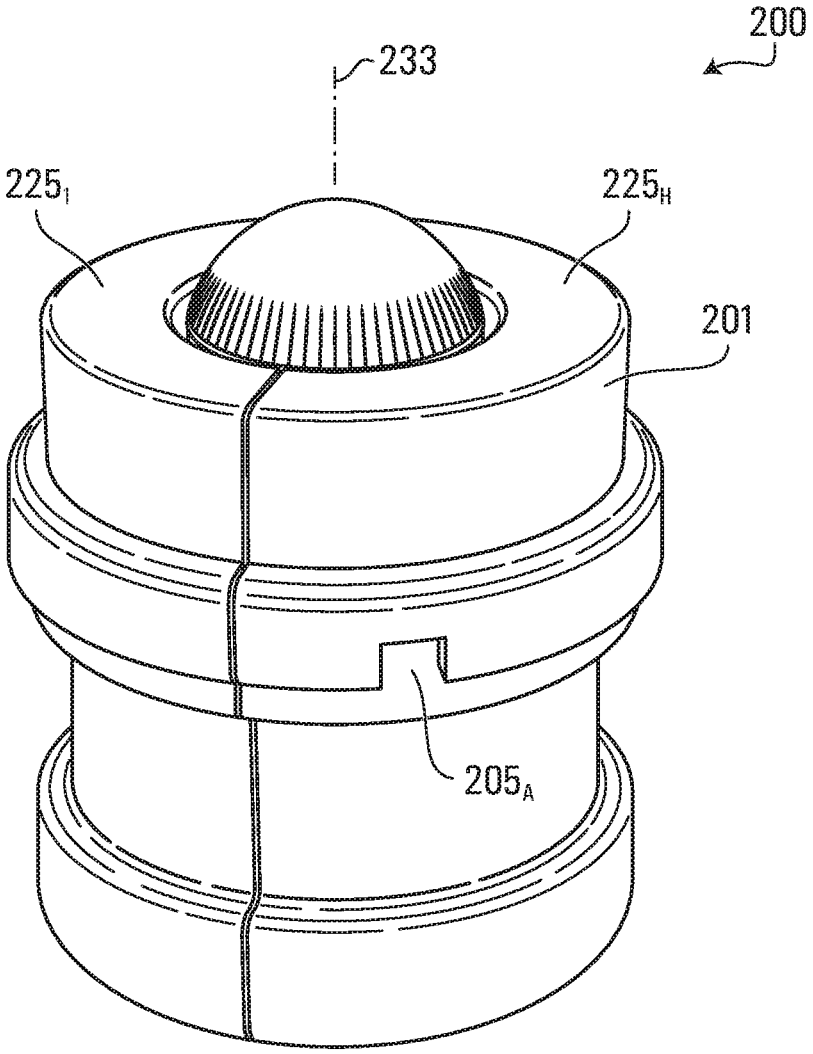
FIG. 9 is a perspective view of an assembly comprising a second embodiment of an adapter and a dispenser held by the adapter, the adapter being in a closed position.
Figure 15:
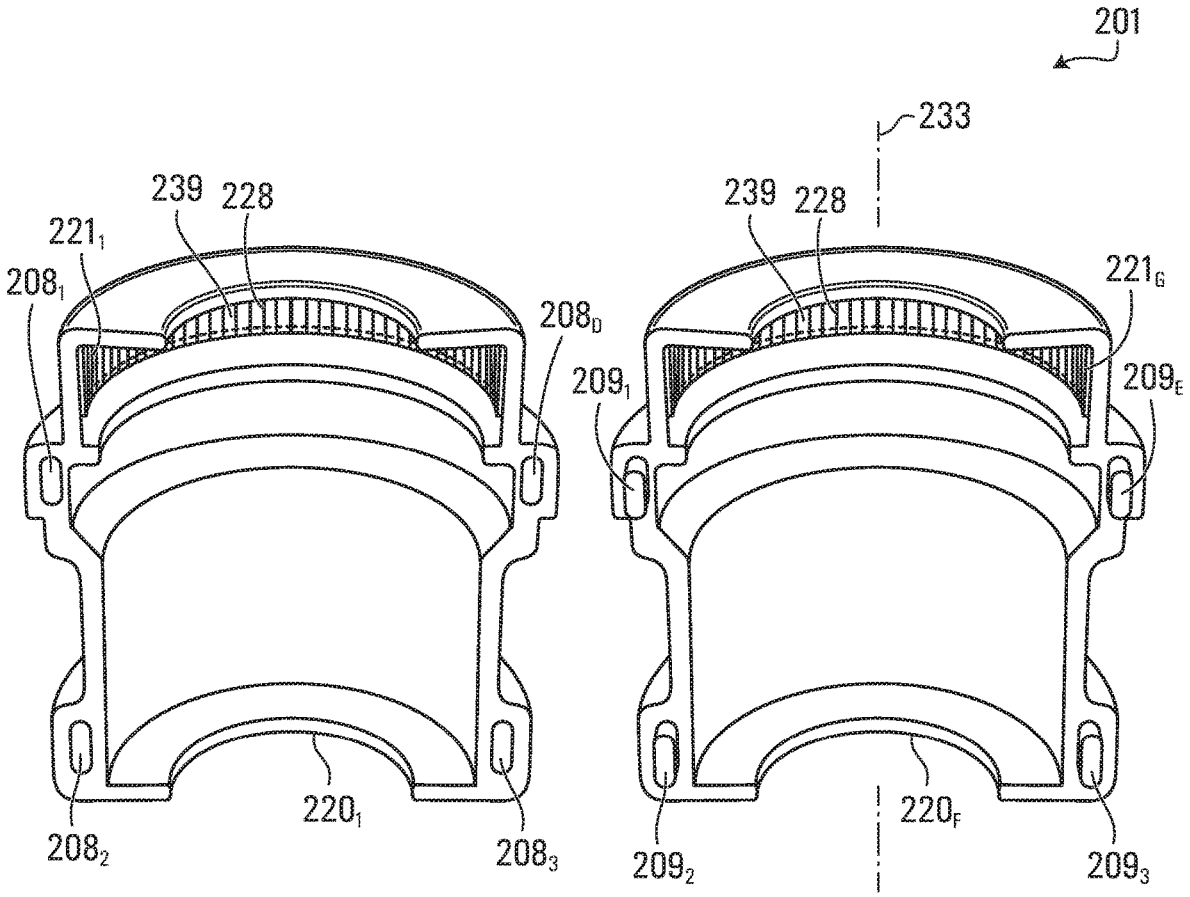
FIG. 15 shows an interior perspective view of the second embodiment of the adapter, with shell components of the adapter detached from one another and in the absence of a dispenser.
Figure 16:
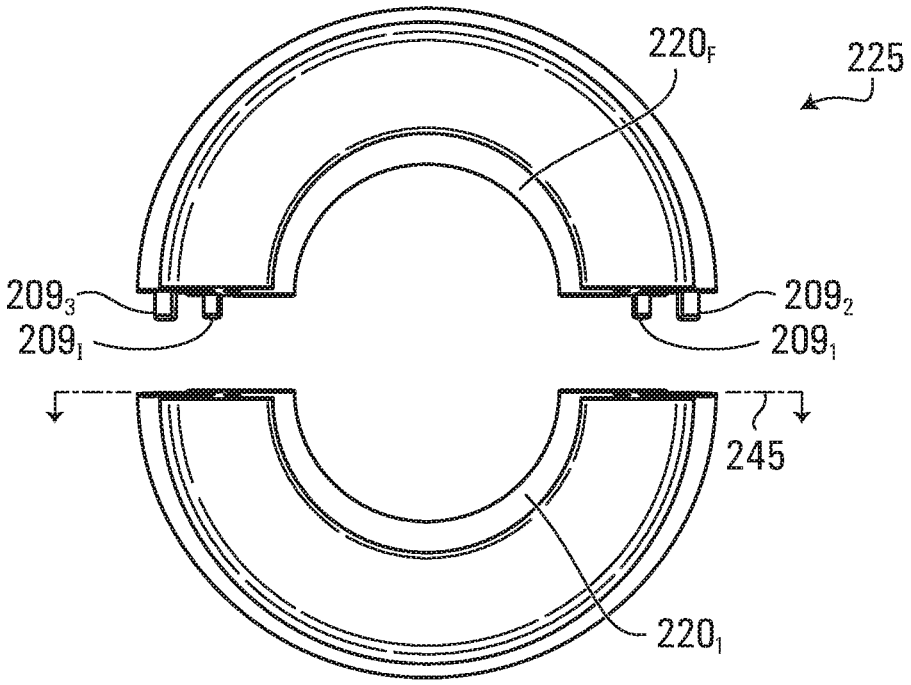
FIG. 16 is a top view of the second embodiment of the adapter, with shell components detached from one another.

With reference to FIG. 9, the adapter 201 comprises two mating shell components $\mathbf{225}_1$, $\mathbf{225}_H$. The two shell components $\mathbf{225}_1$, $\mathbf{225}_H$ of the adapter 101 are in a mating relationship when held together and prevented from separating as a result of being placed in and encapsulated by the holder $\mathbf{131}_J$. This means that, outside of the holder $\mathbf{131}_J$, the two shell components $\mathbf{225}_1$, $\mathbf{225}_H$ are free to disengage from the mating relationship when a separating force is applied outward from the longitudinal axis 233. With further reference to FIG. 15, a mating mechanism for achieving the mating relationship may comprise rectangular shaped grooves $\mathbf{208}_1$, $\mathbf{208}_2$, $\mathbf{208}_3$, $\mathbf{208}_D$ and projections $\mathbf{209}_1$, $\mathbf{209}_2$, $\mathbf{209}_3$, $\mathbf{209}_E$ located on a surface created by an imaginary cutting plane 245 (shown in FIG. 16), hereinafter section surface.

Figure 17:
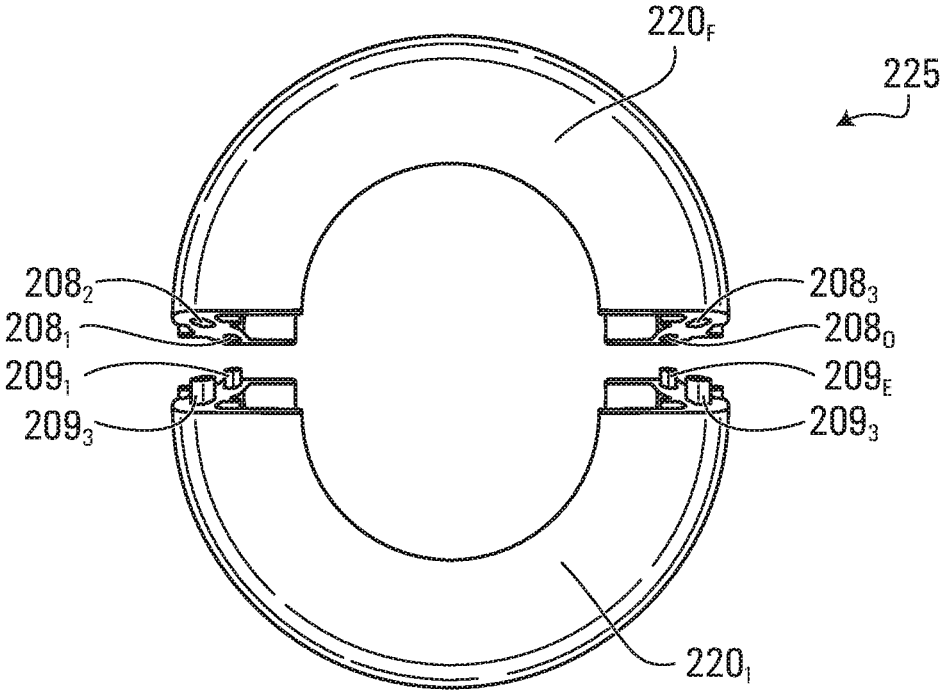
FIG. 17 is a bottom view of the second embodiment of the adapter, with shell components detached from one another.
Figure 18:
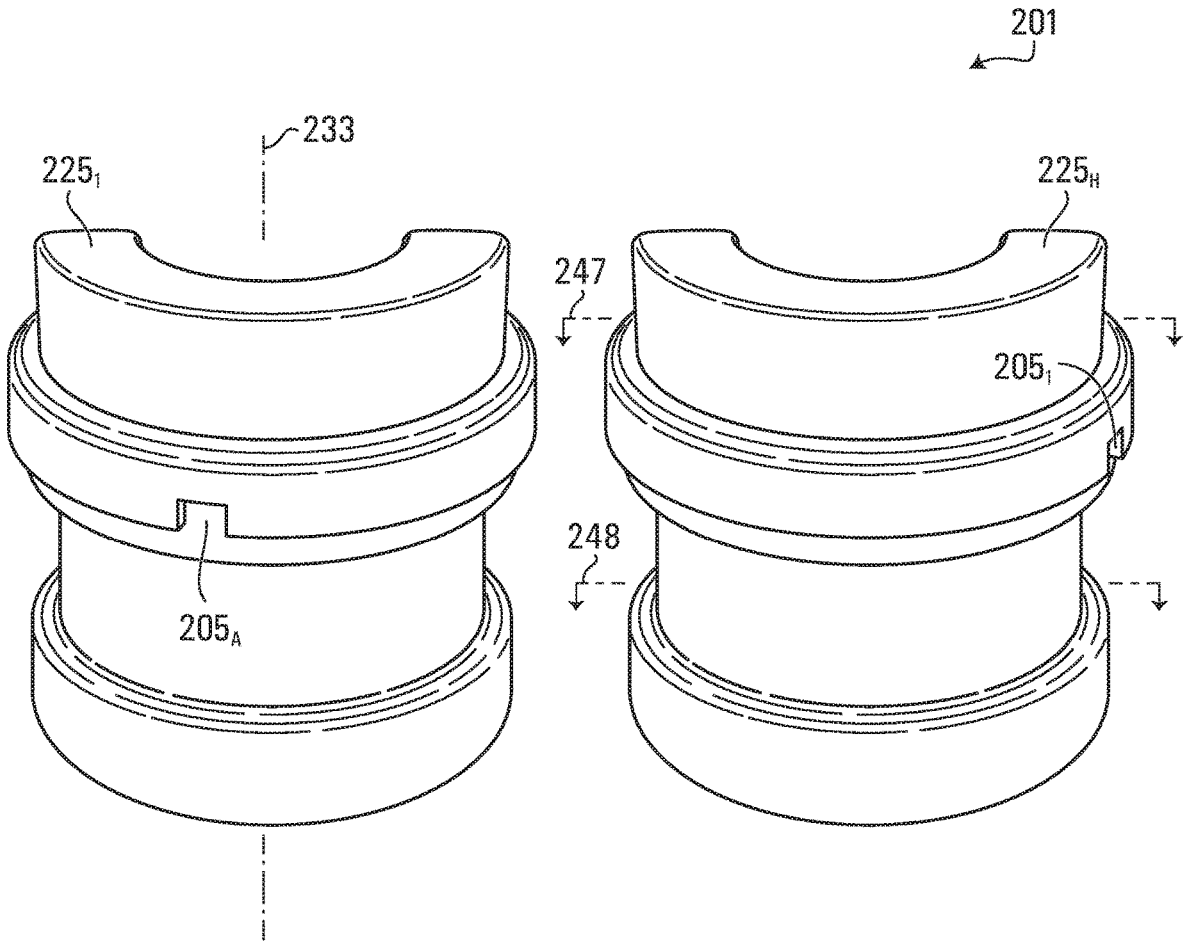
FIG. 18 shows an exterior perspective view of the second embodiment of the adapter, with shell components of the adapter detached from one another and in the absence of a dispenser.

Similarly to the first embodiment for adapter type 1, each of the shell components $\mathbf{225}_1$, $\mathbf{225}_H$ of the adapter 201 comprises a flange $\mathbf{220}_1$, $\mathbf{220}_F$ (as depicted in FIG. 17) for supporting a bottom 246 of a dispenser 202 within the adapter 201 when the shell is closed and the shell components $\mathbf{225}_1$, $\mathbf{225}_H$ are in a mating relationship. Indeed, the flange $\mathbf{220}_1$, $\mathbf{220}_F$ acts as a stopper to prevent the dispenser 202 from being pushed into the empty cavity of the holder $\mathbf{131}_J$ when removing the assembly 200 from the holder $\mathbf{131}_J$ after operation of the mixing device 130.

Figure 12:
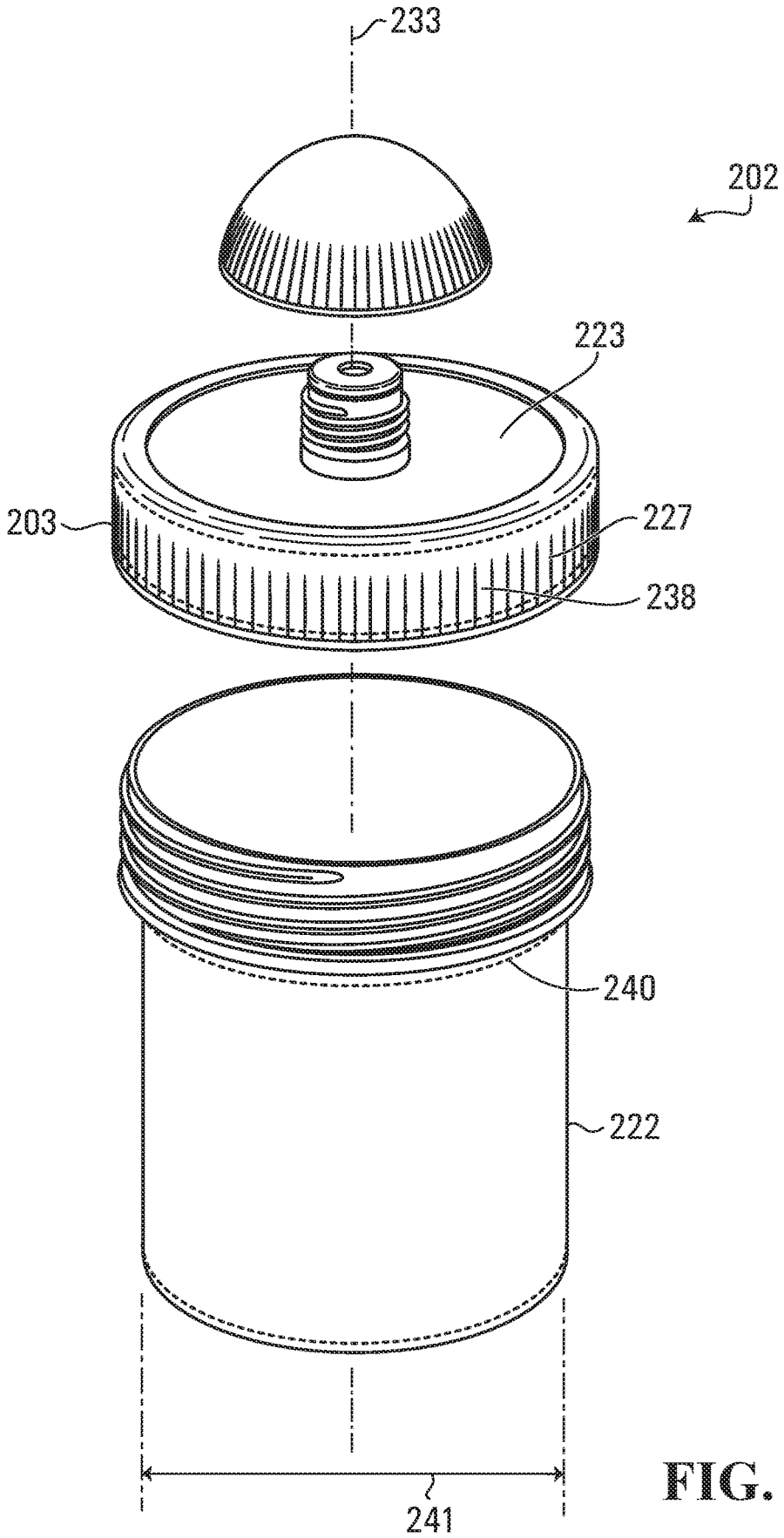
FIG. 12 is an exploded perspective view of the dispenser of FIG. 11.
Figure 13:
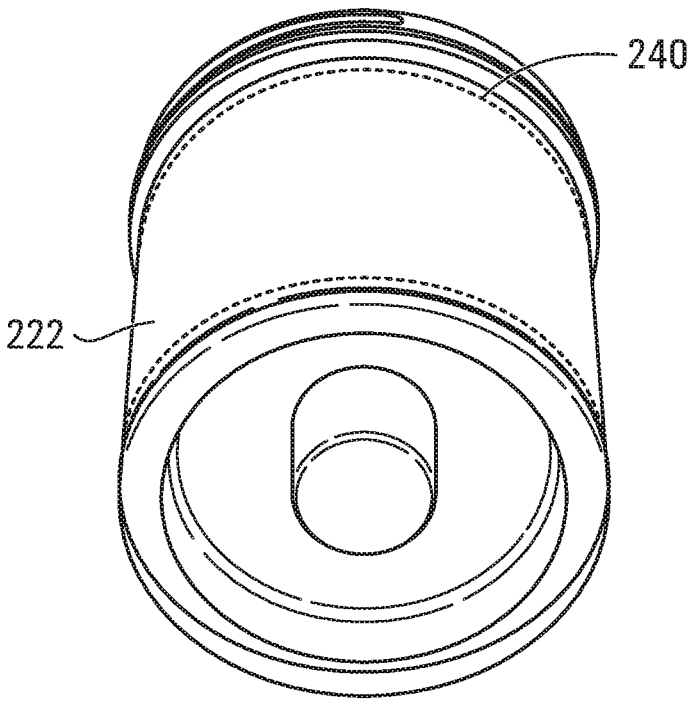
FIG. 13 is a bottom perspective view of the dispenser of FIG. 11.

As illustrated in FIG. 12, there is shown the dispenser consisting of a smooth body 222 and a striated (toothed) cap 223. The smooth body 222 and the striated cap 223 present a generally symmetric profile about the longitudinal axis 233 of substantially cylindrical nature. Furthermore, the cap 223 is radially wider than at least part of the body 222, extending radially outward from the longitudinal axis 233 so as to protrude beyond the body 222.

Figure 24:
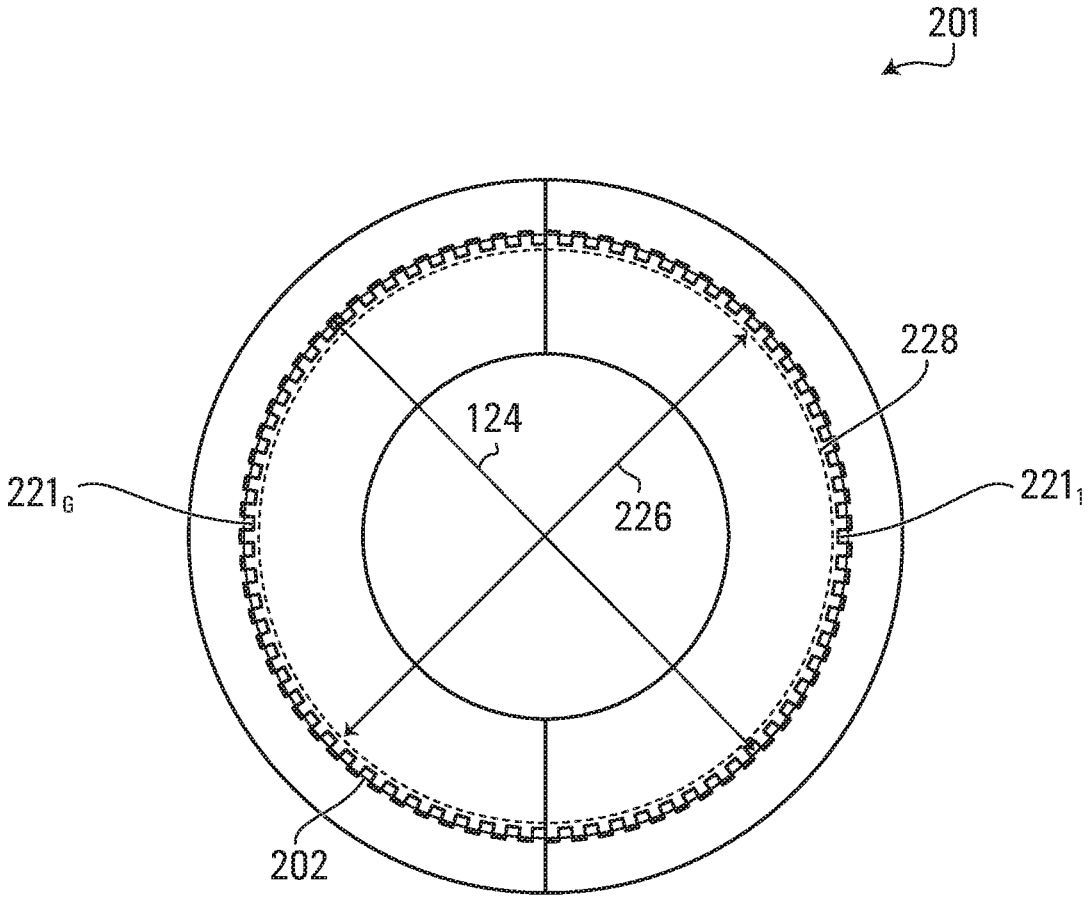
FIG. 24 is cross-sectional view along the line 148 in FIG. 10.

One example of the striated cap 223 embodiment is found atop a so-called EMP (electric mortar and pestle) jar, such as is sold by Samix GmbH of Zella-Mehlis, Germany. In this case, the dispenser 202 presents a set of striations 227 (a set of closely spaced parallel teeth and grooves) along a first outer band 203. With reference to FIG. 12. It should be appreciated that the first outer band 203 surrounds the longitudinal axis 233 and defines a minimum first diameter 224 of an imaginary cylinder (shown in FIG. 24) into which the first outer band 203 may fit. The adapter 201 surrounds at least the first outer band 203 of the dispenser 202. In addition, the adapter 201 is configured to have an inner region $\mathbf{221}_1$, $\mathbf{221}_G$ opposite the first outer band 203 of the dispenser 202 when the dispenser 202 and the adapter 201 are assembled. With further reference to FIG. 24 (which is a cross-section along the line 148 in FIG. 10), this inner region $\mathbf{221}_1$, $\mathbf{221}_G$ defines a maximum second diameter 226 of an imaginary cylinder that may fit within the inner region $\mathbf{221}_1$, $\mathbf{221}_G$ of the adapter 201 when the shell components are in a mating relationship. Again, it is noted that the second diameter 226 is slightly less than the first diameter 224 (e.g., by a difference of less than 5 mm and in some cases by a difference of less than 1 mm and in other cases by a difference of between 1 mm and 5 mm and in other cases by a difference of between 100 microns and 5 mm, to name a few non-limiting possible differences between the first and second diameters).

Figure 10:
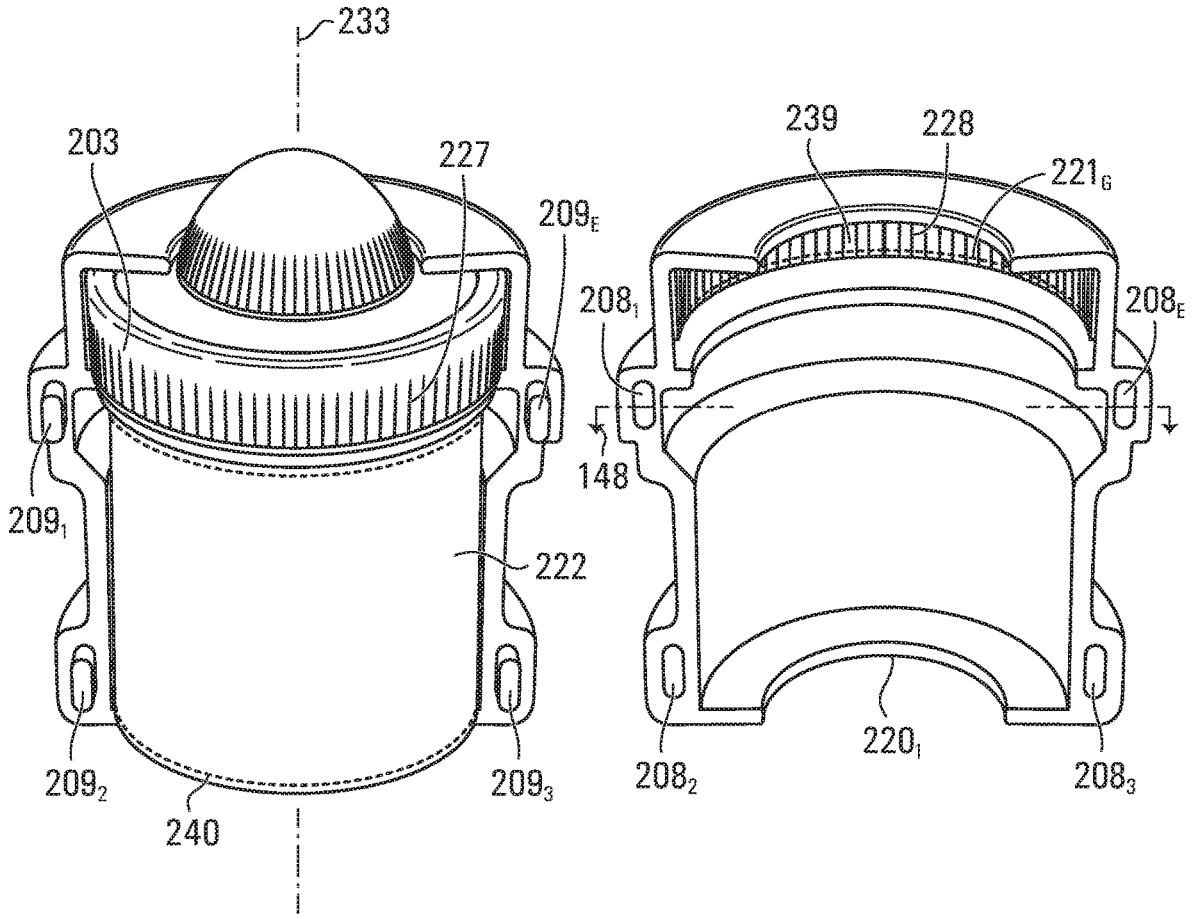
FIG. 10 is an interior perspective view of the assembly of FIG. 9, with shell components of the adapter being detached from one another.
Figure 11:
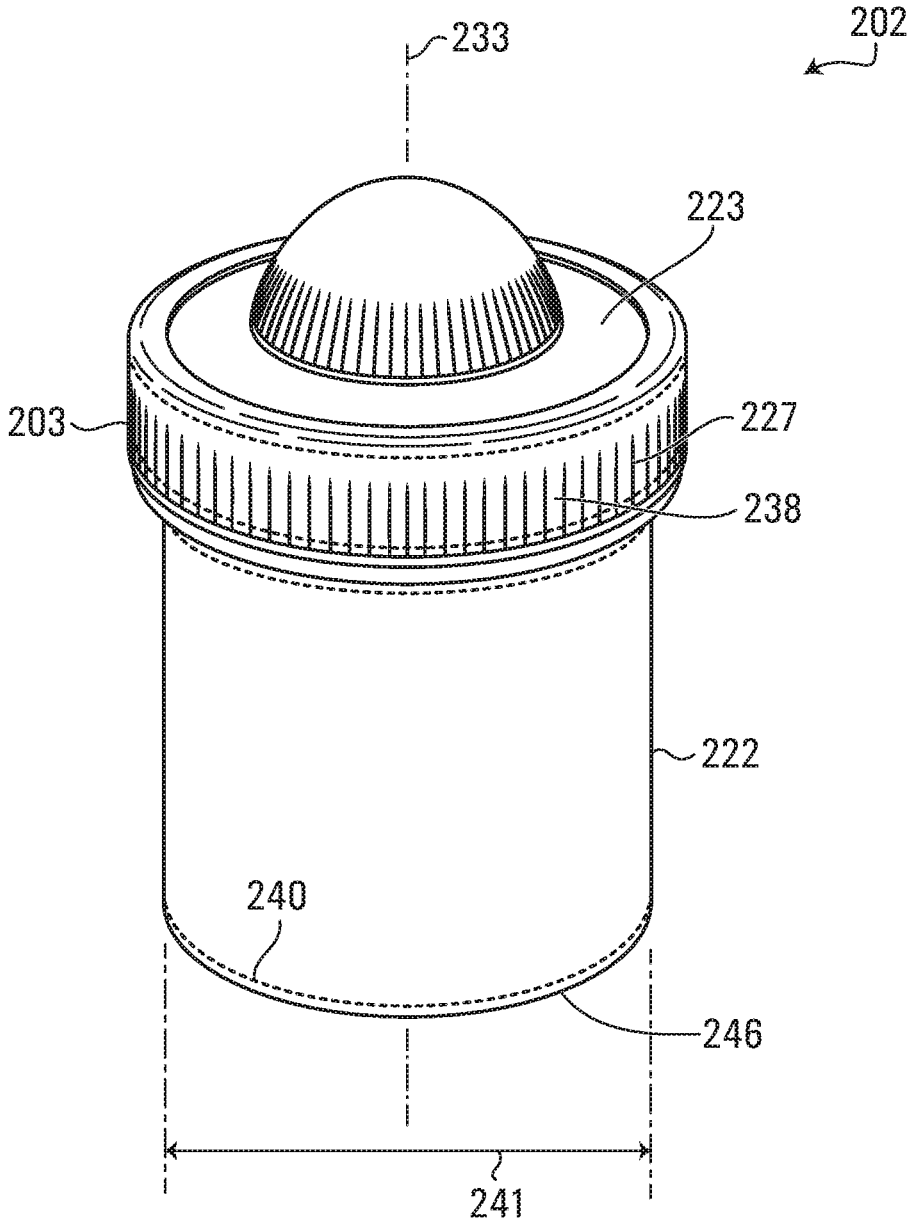
FIG. 11 is a perspective view of a type of dispenser suitable for use with the second embodiment of the adapter.

As shown in FIG. 11, the set of striations 227 of the cap 223 is composed of a plurality of closely spaced parallel lines creating grooves 238 along the first outer band 203. Opposite the first outer band 203, the adapter 201 has a corresponding set of striations 228 along an inner surface in the area of the inner region $\mathbf{221}_1$, $\mathbf{221}_G$. The set of striations 228 of the adapter 201 is composed of a plurality of closely spaced parallel lines creating grooves 239 along the inner surface in the area of the inner region $\mathbf{221}_1$, $\mathbf{221}_G$. With reference to FIG. 10, the striations 228 of the adapter 201 are designed to fit into the grooves 238 formed by the striations 227 of the cap 223. This is an example of a tooth-and-groove mechanism for locking the dispenser 202 to the adapter 201 from the point of view of rotation about the axis 233. As a result, the sets of striations 227, 228 engage one another when the shell components $\mathbf{225}_1$, $\mathbf{225}_H$ are in a mating relationship so as to lock the dispenser 202 to the adapter 201 and thus maintain the dispenser 202 at the same rotation and revolution speed as the adapter 201 and the holder $\mathbf{131}_J$ during operation of the mixing device 130.

Stated differently, the teeth of the adapter 201 and of the cap 223 interlock to prevent rotation of the cap 223 relative to the adapter about the common longitudinal axis 233.

Adapter/Dispenser Assembly for Dispenser Type #3

Figure 25:
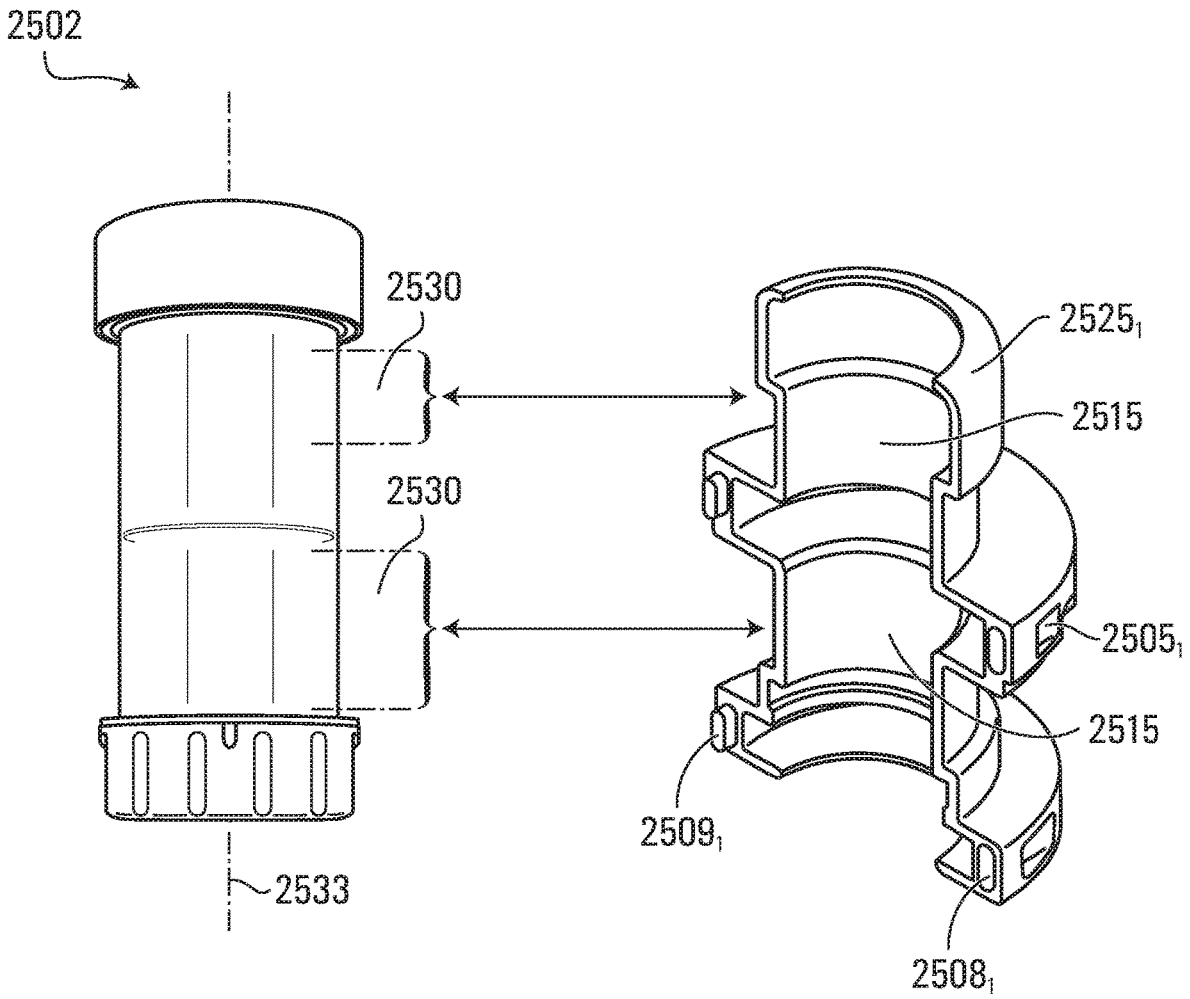
FIG. 25 is an interior perspective view of a shell component of a third embodiment of the adapter, in accordance with a non-limiting embodiment.

FIG. 25 is an interior perspective view of a shell component $\mathbf{2525}_1$ of a third non-limiting embodiment of an adapter. The adapter comprises a closeable shell, of which the shell component $\mathbf{2525}_1$ is a part, and a complementary second shell component (not shown) may similarly be provided. Specifically, this embodiment of the adapter may be used with a UnoDose™ dispenser 2502, available from Reflex Medical, Mahtomedi, Minn., USA. In this case, the adapter has inner regions 2515, each surrounding one of two bands 2530 of the exterior surface of the dispenser 2502. The inner regions 2515 are separated axially by a gap (as are, for example, regions $\mathbf{121}_1$ and $\mathbf{121}_G$). The inner regions 2515 are configured to compress the dispenser 2502 in at least a region of the bands 2530 so as to impede rotational slippage of the dispenser 2502 about its longitudinal axis 2533 relative to the adapter when the shell is closed.

Other Embodiments

It should be noted that for additional grip, the anti-slippage features of two or more embodiments of the adapter described above may be combined so as to provide enhanced anti-slippage functionality.

In other embodiments, the shell components x25$_1$, x25$_H$ of the adapter x01 (x=1, 2, 25) may comprise an integrated locking mechanism (e.g., a latch) that is activated after insertion of the dispenser x02 (x=1, 2, 26) into the adapter x01 but before insertion of adapter/dispenser assembly x00 (x=1, 2, 26) into the holder 131$_J$. The locking mechanism ensures that the shell components x25$_1$, x25$_H$ are not free to disengage from their mating relationship by simple application of an outward force in the opposite direction than what was used to mate the shell components together.

Figure 26:
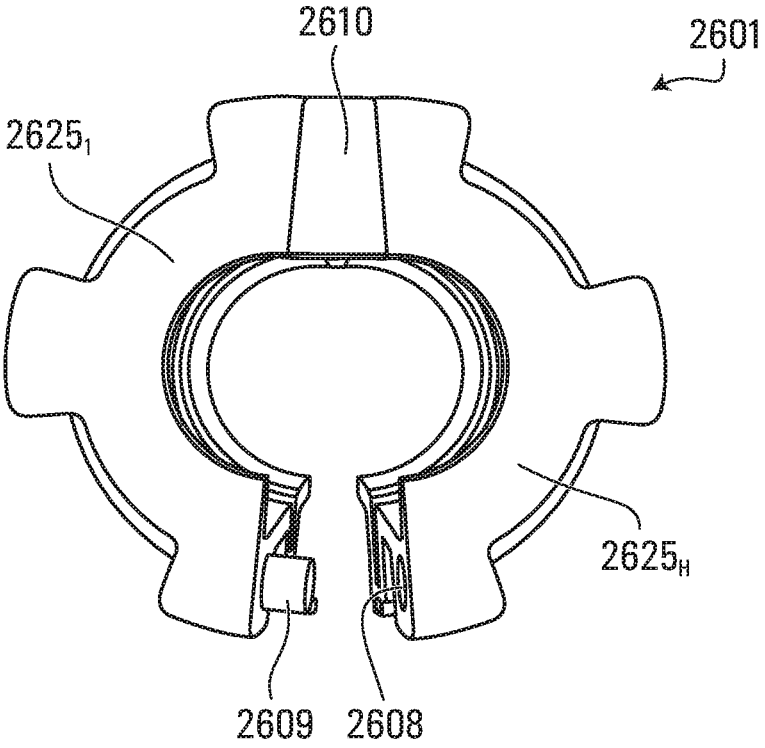
FIG. 26 shows an interior perspective view of two hinged shell components of an embodiment of the adapter, in accordance with a non-limiting embodiment.

In the above embodiments, separation of the shell components x25$_1$, x25$_H$ of the adapter x01 to allow insertion of the dispenser x02 may allow complete detachment of the shell components x25$_1$, x25$_H$. However, this need not be the case in all multi-shell-component embodiments. For example, in some embodiments, and as shown in FIG. 26, the shell components 2625$_1$, 2625$_H$ of the adapter 2601 may remain hinged together, e.g., a hinge 2610 may be present (in lieu of, say, grooves 108$_1$, 108$_2$ and projections 109$_E$ and 109$_3$ of adapter 101). The hinge 2610 may open and close, allowing the shell components 2625$_1$, 2625$_H$ to separate and come together while still being partly connected. A mating relationship between the shell components 2625$_1$, 2625$_H$ is created further to the hinge 2610 being closed, with projections 2609 entering grooves 2608, and the shell components 2625$_1$, 2625$_H$ being prevented from separating as a result of, e.g., being placed in and encapsulated by the holder 131$_J$. It is noted that in this context "separating" the shell components 2625$_1$, 2625$_H$ does not mean that the two shell components are detached from one another, but rather that there is a break that allows part of one of the shell components to separate from part of the other shell component (e.g., through operation of the hinge 2610) to allow insertion of the dispenser (in this case, dispenser 102). In other words, in such embodiments, the shell components 2625$_1$, 2625$_H$ of the adapter 2601 may be separated in one area while still connected in another (e.g., via the hinge). A similar description applies when there are more than two shell components.

In still other embodiments, multiple shell components are not required. For example, in some embodiments, the adapter may comprise a unitary shell component that is made of a material that is sufficiently deformable to allow insertion of a dispenser such that after the dispenser is inserted, an inner region of the unitary shell component applies pressure to the outside surface of the dispenser and/or there will be engagement of teeth, as has been previously described. In one specific non-limiting example of design, the unitary shell component may include a predesigned region (e.g., a thinner but reinforced region) about which the unitary shell component may be bent open, such that when the unitary shell component is re-closed (with the dispenser inside) and inserted into the holder, pressure will be exerted against the outer surface of the dispenser and/or there will be engagement of teeth as has been previously described. For example, it is envisaged that an adapter having a similar shape as shown in FIG. 26 may be constructed as a single unitary piece of material of adequate resilience and flexibility.

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

Although various embodiments and examples have been presented, this was for description purposes, but should not be limiting. All features of embodiments which are described in this disclosure and are not mutually exclusive may be combined with one another. Various modifications and enhancements will become apparent to those of ordinary skill and are within a scope of this disclosure.

What is claimed is:

1. An adapter for use in a planetary mixer for receiving a dispenser, comprising:

at least two mating shell components, wherein the shell components each include:

a circumferential rib that projects from an outer surface of a shell component among the shell components and that is disposed between an upper end of the shell component and a lower end of the shell component, and a notch that is disposed on the circumferential rib and that includes an opening on a lower side of the circumferential rib in a direction of a longitudinal axis of the adapter, and the notch is configured to mate with a corresponding projection on an inner surface of a holder of the planetary mixer to rotationally lock the adapter relative to the holder, wherein, when the shell components are in a mating relationship, the shell components define:

an inner region that is configured to compress at least part of an outer surface of the dispenser to impede rotational motion of the dispenser relative to the adapter, and an outer region that is configured to be placed in and engage with the holder to rotationally lock the adapter relative to the holder, such that the adapter and the dispenser are configured to undergo superimposed revolution and rotation movements in tandem with superimposed revolution and rotation movements of the holder when the adapter is in use in the planetary mixer.

2. The adapter defined in claim 1, wherein the adapter comprises at least one projection in the inner region.

3. The adapter defined in claim 2, wherein the at least one projection comprises a plurality of projections, at least one of the projections being disposed on each of the at least two shell components of the adapter, the plurality of projections impeding slippage of the adapter by deforming the outer surface of the dispenser from opposite radial directions when the shell components are in a mating relationship.

4. The adapter defined in claim 3, wherein each of the projections occupies an arc length corresponding to at least 90 degrees.

5. The adapter defined in claim 4, wherein the at least one projection comprises a plurality of axially spaced projections.

6. The adapter defined in claim 5, wherein the plurality of projections comprises at least two axially spaced projections being disposed on a first of the at least two shell components and at least two axially spaced projections being disposed on a second one of the at least two shell components.

7. The adapter defined in claim 1, wherein adapter has a set of striations along an inner surface in an area of the inner region, the set of striations for complementarily engaging a set of striations along an outer surface of the dispenser when the shell components are in a mating relationship so as to lock the dispenser against rotational motion about the longitudinal axis relative to the adapter.

8. The adapter defined in claim 1, wherein the circumferential rib of one of the shell components includes a plurality of the notches that is configured to mate with a corresponding plurality of the projections on the inner surface of the holder to rotationally lock the adapter relative to the holder.

9. The adapter defined in claim 1, each of the shell components further comprising a flange for supporting a bottom of the dispenser.

* * * * *